US007708279B2

(12) United States Patent
Polgar

(10) Patent No.: US 7,708,279 B2
(45) Date of Patent: May 4, 2010

(54) LOGICAL BOARD GAME AND GAME OF CHANCE ON A STAR-SHAPED BOARD

(75) Inventor: Laszlo Polgar, Perofi ber 3.B.1. cm. 2, 1053 Budapest (HU)

(73) Assignee: Laszlo Polgar, Budapest (HU)

( * ) Notice: Subject to any disclaimer, the term of this patent is extended or adjusted under 35 U.S.C. 154(b) by 0 days.

(21) Appl. No.: 11/361,271

(22) Filed: Feb. 23, 2006

(65) Prior Publication Data

US 2007/0063436 A1 Mar. 22, 2007

(30) Foreign Application Priority Data

Feb. 25, 2005 (HU) ..... 500253

(51) Int. Cl.
*A63F 3/00* (2006.01)

(52) U.S. Cl. ..... 273/261; 273/243

(58) Field of Classification Search ..... 273/260, 273/261, 243; D21/348, 363
See application file for complete search history.

(56) References Cited

U.S. PATENT DOCUMENTS

D74,025 S * 12/1927 Rapport ..... D21/348
1,704,819 A * 3/1929 Beaman ..... 273/261
3,964,747 A * 6/1976 Balmforth ..... 273/261
4,580,787 A * 4/1986 Baker ..... 273/261
D310,392 S * 9/1990 Grimes ..... D21/348
D34,678 S * 5/1994 Korzik et al. ..... D21/363
6,070,871 A * 6/2000 Wilson et al. ..... 273/261
2005/0179203 A1* 8/2005 Schroeder et al. ..... 273/260

FOREIGN PATENT DOCUMENTS

GB 2033239 5/1990

OTHER PUBLICATIONS

Pritchard, D.B., The Encyclopedia of Chess Variants., 137-147 (1994).

* cited by examiner

*Primary Examiner*—Vishu K. Mendiratta
(74) *Attorney, Agent, or Firm*—Foley & Lardner LLP

(57) ABSTRACT

The present invention is directed to a logical board game featuring hexagonal primary playing fields as a playing area, and pieces, the primary playing fields being congruent geometrical figures that form a regular six-pointed star-shaped playing area that has axes of symmetry, one playing field of which is at the center of the playing area, and that the primary playing fields adjoin, by at least two of their sides, their neighboring primary playing fields.

22 Claims, 43 Drawing Sheets

LOGICAL BOARD GAME AND GAME OF CHANCE ON A STAR-SHAPED BOARD

CROSS-REFERENCE TO RELATED PATENT APPLICATIONS

This application claims the benefit of priority to Hungarian Patent Application No. PO500253 filed on Feb. 25, 2005.

BACKGROUND OF THE INVENTION

The subject of the invention is a logical board game involving a playing area of regular hexagonal cells, and pieces. The cells are congruent geometrical figures. The subject of the invention is also a game-of-chance board game involving a playing area of regular hexagonal cells as well as a roulette cylinder and/or tumbling die or other random number generator and/or computer and tokens.

The invented games are played on a special playing area (board). Industrial design patents numbers D03 00347 and D03 00348 describe a similar special playing area pattern.

The board games that are the subject of this invention belong to two sub-categories, namely logical board games (I) and games that involve elements of games of chance (II).

Chess belongs to the sub-category of logical board games (I). A characteristic of the board games described in the invention is the fact that the same board can also be used for playing logical games such as horse race, pawn war, French chess (also known as "Giveaway Chess," but referred to as "French Chess" throughout), halma, pyramid, checkers (shashki), and triangles (merelles).

The games described in the invention are further characterized by the fact that, when the starting setup is defined randomly (by means of a draw), the same board can also be used for playing several, already existing, board games that involve elements of games of chance. Thus, using the chess pieces, several roulette-like games can be played such as (chess-) queen roulette, rook-bishop roulette, king-knight-2 pawns roulette and lotto chess, as well as lotto, roulette, dreidel, and blackjack. This feature distinguishes the invented games from any formerly known (reform) chess games.

I have given my invention the commercial name Polgár Superstar® board game indicating that these games are members of the Polgár Superstar® family of games that are playable on the Polgár Superstar® six-pointed star-shaped board. (In the present description of the invention, instead of the term "board" I will mostly use the more specific expression "playing area", also formerly referred to as the "playing field". Also, I have substituted the term "field" or "cell" with the term "primary playing field".)

One of the most ancient known games, chess, which dates back more than 2,000 years, has a playing area of 8×8 square-shaped cells organized into vertical columns and horizontal rows usually on a board, table or box surface, and a set of playing pieces comprising two times 16 pieces and pawns. The pieces are shaped as figures that act in accordance with their established roles within the rules of the game. During the past five hundred years the game has been played according to the same rules as a game for two players who oppose one another as "white" and "black" in accordance with the starting move. All this is indicative of the strict rules of this traditional game.

The large number of pieces and cells, according to the rules, results in such a large number of move combinations that the game of chess is regarded allover the world as an intellectual pursuit highly suitable for developing complex combinative abilities and, consequently for realizing various strategic and tactical concepts.

It is no coincidence that, alongside traditional chess (8×8 board, FIDE-rules), a large number of reform chess ideas have also been published. Several innovations have been attempted in order to make the game more dynamic.

One opportunity lies in changing the size of the board, or the shape and geometry of the playing area. Thus, a smaller board may result in a certain simplification and can speed up the game since, logically, fewer pieces can be placed on the smaller board bearing in mind the reduced size of the playing area. Examples of such commercially available games are the well-known Alapo, Apocalypse, Archer, Baby, Benighted, Bird, Chessence, Los Alamos, Microchess I and II, and Minichess I, II, III and IV. Larger boards that require the inclusion of more pieces, sometimes involving new pieces (typically major pieces, with new ways of moving and capturing), make it possible for more than two people to play on the same board at the same time. One example of this is Paulovits chess (1931), which is played on a 10×10 board, and others are those games detailed in Hungarian patent descriptions 130.346 and 187.705. The overwhelming majority of these reform chess games, however, did not result in the desired acceleration while preserving the traditional values—particularly the high-level intellectual pleasure produced by the clashing of minds—of the game. The majority of reform chess versions have become over-complicated, the playing areas confusing, and the games slow and heavy.

Another option is to vary the basic setup. In traditional chess the basic setup is fixed, and characterized by symmetry and the opposition of pieces. In my game the placement of major pieces on the base-line—both in terms of position and order—is optional, making it possible to checkmate the opponent in just one move!

Grandmaster Pal Benko published his version of reform chess, Prechess, in 1978. Here, the placement of the major pieces in the basic setup is not determined and can be asymmetrical. Prechess, however, has not become widespread. American chess genius Robert Fischer also proposed a non-determined placement of the major pieces, while preferring to maintain the symmetrical basic setup of the major pieces (white pieces opposite to the equivalent black ones).

Star-shaped chessboards have already been invented by many others. The chess game known as "Baltic Four-Handed" in the technical literature (L. Kieseritzky, 1835?), for example, can be played on an eight-pointed star-shaped chessboard. Hungarian patent description 168.051 details a board game that involves an eight-pointed star-shaped playing field comprising 128 congruent rhomboid-shaped fields.

Besides square-shaped cells the chessboard can be "paved" with fields of other geometrical shapes. Diamond Chess, for example, features triangular cells.

The technical literature contains mention of several playing areas made up of hexagonal playing fields that connect like the cells of a honeycomb (The Encyclopedia of Chess Variants, Games and Puzzles Publications, © D. B. Pritchard, Surrey, UK 1994): "Hyperchess", "King's Colour" page 363; "Hexachess", page 138, and "Hexagonal chess", pages 138-145. There are dozens of versions of reform chess in which the board is made up of hexagonal fields, such as Chessex, Chessnik, En Garde, Galachess, Haynie's Hexagonal Chess, Hexabeast, Hexmate, Hexachess, Hexagonal, Hexagonia, Hexchad, Hex, Hexchess, Hexshogi, Ludus Chessunculus, Mi Arena Chex, Mini Hexchess, Three-Handed Hexagonal, Triangular, Tri, Trimex, Triscia, Triss, Troy, Chazz Hyperchess, King's Colour, Mars, Quatrechess, etc.

In 1978, Nerida Fay Ellerton invented a six-pointed star-shaped chessboard paved with hexagons—containing as many as 400 fields in three different colours, making the game complicated and cumbersome. Details of the game are given in British patent description GB 2 033 239, and the star-shaped playing area divided into hexagonal fields is represented in diagram 4. The playing area represented in the diagram significantly differs from the starshaped playing area described in our study. The board shown there is not suitable for fulfilling the functions that I have set out for the games I have devised. Over the past 25 years, I have no information about the spread of the games mentioned in the above document.

SUMMARY OF THE INVENTION

In summary, it can be stated that none of the previously known reform chess games, nor those games in combination with other board games, can fully serve the purposes specified by our invention.

In terms of the present invention, one of my intentions was to provide a game for chess enthusiasts, and for lovers of logical games in general, which preserves the rules and approach of chess and is practically identical with chess, while being more dynamic, played on a geometrically original board that offers uniquely novel combinative potential.

The concept was based on the recognition that, on the playing area described in the invention, while keeping, or slightly modifying, the piece set of traditional chess and while largely adhering to the rules of traditional chess and reform chess versions, one can create modem logical games that are able to develop combinative skills and creativity in new ways. One further advantage is that the same playing area (or board) can be used to play enjoyable games of chance.

I fulfilled the task I had set myself by means of the logical board game in accordance with specification 1, and the game-of-chance board game in accordance with specification 15.

Favourable solutions for the two inventions are the varieties in accordance with specifications 2-14 and 16-23.

DETAILED DESCRIPTION OF THE PREFERRED EMBODIMENTS

When describing the variations and examples I shall refer. to the chess pieces by their commonly used names, and in the diagrams they will be depicted using their commonly accepted symbols. (See the regulations of the International Chess Federation, for example on the website of the Hungarian Chess Federation: http://www.chess.hulhu/szabalyzatok-.php3). The chess pieces in the diagrams will not therefore be indicated by specific reference numbers but by the icons used in the above-mentioned regulations. However, when necessary the individual fields (cells) will be referred to by their number, which can also be found in the diagrams.

The board game inventions can be played on a six-pointed star-shaped board, which represents a special playing area. The board game inventions are members of the Polgár Superstar® family of games. One sub-category (I) of the board game inventions is formed by creativity developing logical games such as horse race, pawn war, French chess, halma, pyramid, checkers (shashki) or merelles. The other sub-category (II) is made up of games of chance such as (chess-) queen roulette, rook-bishop roulette, king-knight-two pawn roulette, lotto, roulette, dreidel and blackjack.

In terms of the logical board games, the major differences between the chess-like game ("star chess") on the one hand, and traditional chess and variations of reform chess on the other, can be outlined as follows.

The cells on the Polgár Superstar® six-pointed star-shaped board are hexagonal. The cells are of a single color, and there are two varieties of the board. The smaller version has 37 fields and 20 pieces, while the larger, "grand" version has 73 fields and 28 pieces.

The playing area made up of hexagonal cells is symmetrical, which means that there is a cell in the middle of the star formation—in the 37-cell version it is cell 19, and in the 73-cell version it is cell 37—from which point the entire shape is centrally symmetrical.

The Polgár Superstar® six-pointed star-shaped board is made up of 37 hexagonal cells organized in the shape of a six-pointed star. In the so-called Grand version of the game there are 73 hexagonal cells, also organized in the shape of a six-pointed star. The rules of this latter game are identical to those used in 37-field Polgár Superstar® star chess.

Figure 9:
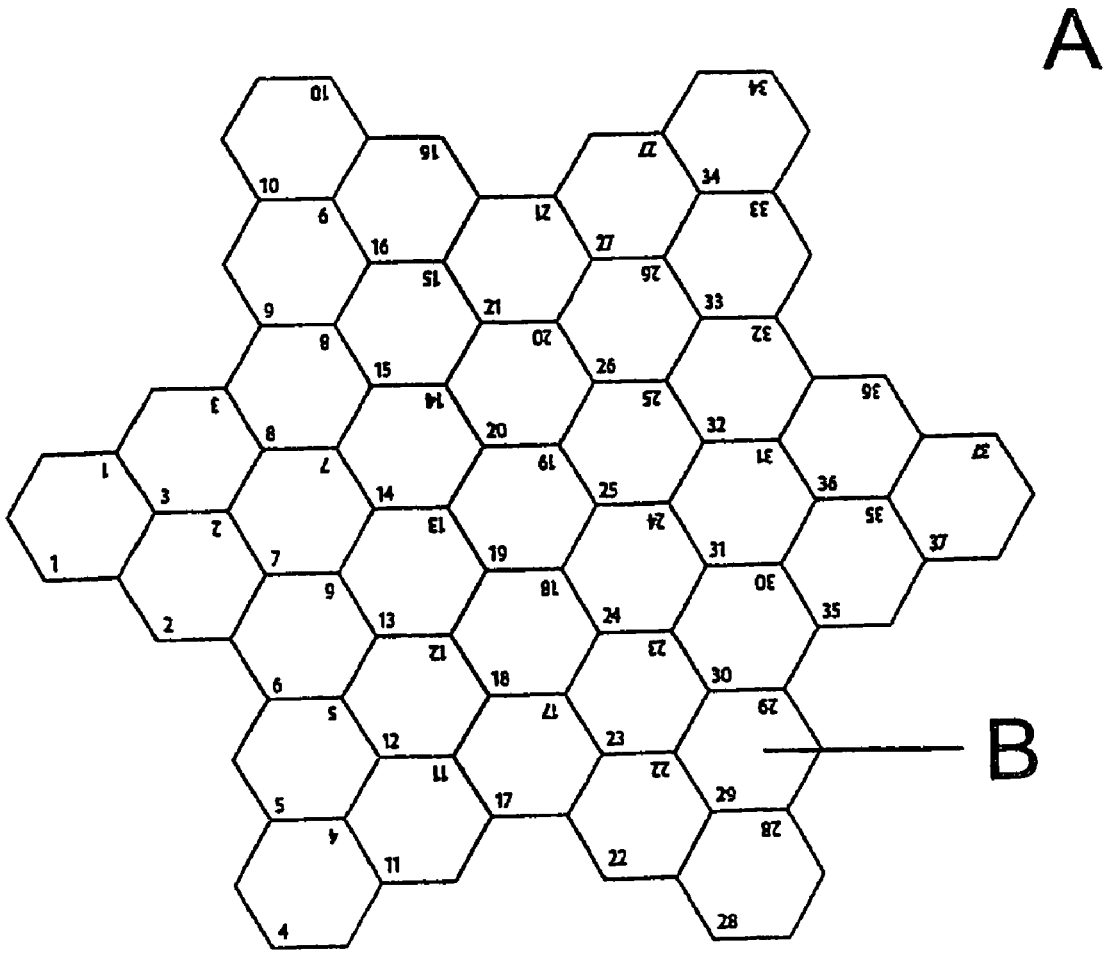
FIG. 9 shows the empty playing area (A) comprising 37 numbered playing fields (B)

As shown in FIG. 9, the game board has a first hexagonal playing field, identified as No. 10, having a first edge adjacent to a second edge which form a first internal corner, the first internal corner being opposite from a first primary corner of the board. The board includes a first row of hexagonal playing fields, identified by Nos. 10, 16, 21, 26, 32, 36, and 37, each having a connecting edge parallel to the first edge of the first hexagonal playing field. The first row of playing fields are connected to the first edge of the first hexagonal playing field, wherein the connecting edge of each hexagonal playing field is coterminal with the connecting edge of an adjacent hexagonal playing field. The first row of hexagonal playing fields has a last hexagonal playing field which forms a second primary corner of the board. The board also includes a second row of hexagonal playing fields each having a connecting edge parallel to the second edge of the first hexagonal playing field. The second row of playing fields are connected to the second edge of the first hexagonal playing field, wherein the connecting edge of each hexagonal playing field is coterminal with the connecting edge of an adjacent hexagonal playing field. The second row of hexagonal playing fields has a last hexagonal playing field which forms a third primary corner of the board.

The board further includes a third row of hexagonal playing fields each having a connecting edge parallel to one another, wherein the connecting edge of each hexagonal playing field is coterminal with the connecting edge of an adjacent hexagonal playing field. The third row of hexagonal playing fields spans between the second and third primary corners of the board such that the first, second, and third rows of hexagonal playing fields form an equilateral triangle bounded by the first, second, and third primary corners of the board.

The board includes a plurality of internal rows of hexagonal playing fields parallel to the first row of hexagonal playing fields and connecting the second row and the third row of hexagonal playing fields, wherein each internal row of hexagonal playing fields connects a hexagonal playing field of the first row with a corresponding hexagonal playing field of the second row of hexagonal playing fields. The board also includes at least one external row of hexagonal playing fields parallel to the first row of hexagonal playing fields, wherein the external row has a midpoint aligned with a midpoint of the first row of hexagonal playing fields. The external row also has a central hexagonal playing field aligned with the midpoint of the first row and forms a first secondary corner of the board. The board further includes at least one external row of hexagonal playing fields parallel to the second row of hexagonal playing fields, wherein the external row has a midpoint aligned with a midpoint of the second row of hexagonal playing fields. The external row also has a central hexagonal playing field aligned with the midpoint of the second row and forms a second secondary corner of the board. The board further includes at least one external row of hexagonal playing fields parallel to the third row of hexagonal playing fields, wherein the external row has a midpoint aligned with a midpoint of the third row of hexagonal playing fields. The external row also has a central hexagonal playing field aligned with the midpoint of the third row and forms a third secondary corner of the board.

Apart from the different geometry of the playing area, the other visible differences are as follows.

On the one hand, there are fewer pieces—in accordance with the reduced number of playing fields: in the 37-field game each player has five major pieces and five pawns, making a total of 20 pieces, leaving 17 cells free in the basic setup, while in the 73-field Grand version each player has seven major pieces and seven pawns, making a total of 28 pieces and 45 free cells. (In the latter game, the basic setup begins with two queens for each player, which—along with the presence of two knights for each player—makes the game extremely dynamic, varied and innovative.)

On the other hand, since the placement of the major pieces on the baseline—both in terms of the order of placing and the position of the individual major pieces—is variable, even the baseline may contain variations striking for their novelty compared to the cliched openings and monotony of the routine-like early stages of the traditional game. This makes it particularly suitable for developing combinative abilities and creativity.

The major pieces are not placed on the baseline of the unique six-pointed star-shaped board in a predetermined order, but optionally; the baseline so generated may thus include multiple asymmetries, the corresponding black and white major pieces not being placed in opposition to one another. This is one of the unique, distinctive features of the board game invention.

Another distinctive feature is that the Grand version of the game can be played not just by two, but also by three players. The 73-field playing area can also be used for 3×14, that is, 42 pieces, and if the axes of symmetry that are perpendicular to the baseline form a 120 degree angle, the three players' pieces, because of this symmetry, have an equal chance of winning while still leaving sufficient space to play.

Another distinctive and advantageous feature of the board game inventions is that the same board can be used for playing the following games: horse race, pawn war, French chess, halma, pyramid, checkers (shashki) and triangles (merelles).

A further distinctive feature of the game inventions is that if the basic setup is generated randomly (by means of a draw), they can be played as games of chance. This further distinguishes the games from any previously existing games of (reform) chess.

I shall begin the more detailed description of the board game inventions with the sub-category of logical board games (1I), and within that the chess-like game of star chess.

In the star chess game invention, as in traditional chess, there are two, counter-interested, equal sets of pieces—made up of major pieces and pawns—of different color, which are named the same as, and look identical to, traditional chess pieces. These pieces basically move according to the rules of traditional and reform chess, taking into account the differences that arise from the different playing area. One distinctive feature of the game is that—in accordance with the fundamental changes in the playing area—the movement of the pieces changes. The way in which the pieces move is not identical to the movement of the chess pieces in any of the (reform) chess games.

I will therefore detail below the possible movements of the individual pieces, adding explanatory diagrams.

The cells are numbered from left to right, increasing by columns from the bottom to the top. White pieces are always placed on the bottom, and black pieces on top—as in traditional chess. On the 37-field board the cells on the baseline are numbered: 4, 11, 17, 22, 26 (white), and 10, 16, 21, 27 and 34 (black). On the 73-field board the cells on the baseline are numbered: 7, 17, 26, 34, 41, 49, 58 (white), and 16, 25, 33, 40, 48, 57 and 67 (black).

The King. The king may move one cell in any direction, as long as no piece stands in its way. The king may capture in any direction. The king is the only piece that may not be captured. The king may not move to any cell that is occupied by any of his own fellow pieces, or that is being attacked by an opposing piece, or that is next to the opposing king. Castling is not allowed. (See diagram 1.)

The Queen. The queen may move any number of cells in any direction as long as no other piece stands in its way. The queen may not move in the same manner as the knight. (It may, however, move in the same manner as the king, rook, and bishop.) It may take any of the opponent's pieces that stand in its way. The queen may not move horizontally. (See diagram 2.)

The Pawn. In its first move the pawn may progress one or two cells forward. After making its first move, the pawn may only progress one cell forward. The pawn may capture forward and diagonally one field to the right or left (from cell 5 it may also capture on cell 12, and from cell 29 on 23.) The pawn is the only piece that may not move or capture backwards. When two pawns are directly opposite one another neither of the pawns may move, and likewise, if another piece (of the same or of the opposing color) stands in front of the pawn, the pawn may not move. Pawns may move to cells 1, 2, and 3 and 35, 36, and 37 only by capturing. When a pawn reaches the last row, or the opponent's first row, it must be promoted. It may be promoted a) into a queen of its own color, b) into a rook of its own color, c) into a bishop of its own color, d) into a knight of its own color, but never into a king of its own color. It may be promoted even if the original piece of the same color is still on the board. En passant capture is not permitted in this game. (See diagram 3.)

The Rook. The rook may move any number of cells, but only vertically, as long as no other piece stands in its way. It may capture any of the opponent's pieces that stand in its way. The rook may never move to cells number 1, 2, 3, 35, 36 and 37. (The rook is the weakest of the major pieces.) A king+a rook may only checkmate the opposing king in exceptional cases (see diagram 4).

The Bishop. The bishop may move any number of cells diagonally forwards and backwards, as long as no other piece stands in its way (see diagram 5). It may capture any of the opposition's pieces that stand in its way.

The Knight. The knight may jump (capture) to any of the cells as shown in the diagram (see diagram 6). This is the only piece that may jump over another piece. In this game, the knight is a much more powerful piece than in traditional chess.

Basic Setup. Diagram 7 shows one possible basic setup for the 37-cell game. In the basic setup the major pieces stand on the bottom line (on cells 4, 11, 17, 22 and 28) and on the topmost line (on cells 10, 16, 21, 27 and 34). The pawns are placed in front of the major pieces. At the beginning, the players place the major pieces one by one on the board, in alternating order. One may not capture one's own pieces. Diagram 8 shows one possible basic setup for the 73-cell game.

Diagrams 9 and 10 show the empty playing area of the star chess game invention without pieces, complete with the reference signs mentioned in the text of specification 2. Diagram 9 shows the playing area of the 37-cell version in accordance with specification 2, while diagram 10 shows the playing area of the 73-cell Grand version in accordance with specification 4.

In the following I will illustrate other board games I have invented using examples (sample games), without in any way limiting copyright to the mentioned examples.

EXAMPLES

Sample Games

Example 1

Horse Race

A game for two players. Instead of pieces and pawns, only knights are placed on the baseline. The knights move according to the rules of Polgár Superstar® star chess (see description above). Aim: To take over the opponent's starting position. The winner may not finish with fewer knights on the board. Diagram 11 shows a starting setup; below I offer a sample game that demonstrates the specific characteristics of this game on this board.

Sample game:

1. ♘28-24 ♘34-20 2. ♘4-13 ♘21-24 3. ♘11-24 ♘10-3 4. ♘22-35 ♘3-5 5. ♘35-26 ♘27-36 6. ♘17-31 ♘20-12 7. ♘24-21 ♘12-25 8. ♘13-9 ♘25-17 9. ♘31-27 ♘36-27 10. ♘9-27 ♘5-22 11. ♘26-13 ♘22-13 12. ♘21-13 ♘16-7 13. ♘27-19 ♘7-24 0:1

Example 2

Pawn War

A game for two players. In the basic setup there are only one king and five pawns, while in the Grand version seven pawns of each color are placed on the board. The kings may be placed anywhere on the board, in front of or behind the pawns. The pieces move according to the rules of Polgár Superstar® star chess as explained above. If a player's pawn reaches the opponent's baseline then the pawn must be promoted into a queen, rook, knight or bishop. Aim: To checkmate the opponent's king. The game may also finish in a draw.

Diagram 12 shows a starting setup; below I offer a sample game that demonstrates the specific characteristics of this game on this board.

Sample game:

1. 23-24 9-7 2. ♔17-23 15-13 3. ♔23-30 ♔21-15 4. ♔30-31 7-6 5. 18-13 ♔15-14 6. 24-25 (6.12-6 20-18 0:1) ♔14-13 7. ♔31-24 6-12 8. 5-12 20-19 0:1

Example 3

French Chess

A game for two players. The major pieces are placed on the bottom (4, 11, 17, 22, 28) and top lines (10, 16, 21, 27, 34). At the beginning the players place the major pieces on the board one by one, in alternating order. The pawns are placed in front of the major pieces. A player may not capture his or her own pieces. The pieces move according to the rules of Polgár Superstar® star chess, as explained above. Pawn promotion is possible. Exceptions and differences: The king may move into check and the king may be captured. If a player is unable to move, the opposing pawns change places, and this counts as a move. Aim: To have all one's pieces captured. The winner is the player whose pieces are all captured. If neither player is able to move, the game ends in a draw. The game also ends in a draw if neither player is able to sacrifice a piece.

Diagram 13 shows a starting setup; below I offer a sample game that demonstrates the specific characteristics of this game on this board.

Sample game:

1. 23-25 20-25 2. ♕22-25 15-13 3. ♕25-9 ♕10-9 4. ♘4-13 ♕9-5 5. ♔11-5 ♘21-13 6. 18-13 ♘27-1 7. 13-14 ♘1-12 8. ♔5-12 ♔16-10 9. ♔12-13 26-24 10. ♘17-30 24-30 11. ♔13-19 33-31 12. ♔19-20 ♔10-9 13. 14-15 ♔9-15 14. ♔20-15 ♖34-32 15. ♔15-20 ♖32-34 16. ♔20-19 ♖34-32 17. ♔19-25 ♖32-34 18. ♔25-32 ♖34-32 19. 29-30 (csere!) ♖32-34 20. ♖28-29 ♖34-32 dontetlen ½:½

Example 4

Halma

A game for two or four players. Requires four pieces for each player. The pieces may move vertically or diagonally. There is no capturing. Jumping is allowed (as is jumping in series). Pieces may also move backwards. Pieces that are jumped over may not be captured. Aim: To occupy, by moving diagonally, the starting positions of the opposing pieces. The player who is first to occupy the opponent's cells is the winner. (A player must leave his or her own starting cells in seven moves.) The game is similar to Pyramid, but here pieces may also move vertically. The pieces may take the form of tokens, but may also be identical chess pieces, for example pawns.

Diagram 14 shows a starting setup (4, 5, 11, 12; 33, 34, 26, 27). Below I offer a sample game that demonstrates the specific characteristics of this game on this board.

Sample game:

1. 12-18 33-20 2. 4-17-19-21 27-25 3. 11-17 26-24-12 4. 17-19-32 12-11 5. 5-12 34-33 6. 32-34 33-32 7. 12-24-26 32-19-17-4 8. 18-24 25-19 9. 24-25 20-18 10. 25-27 18-12 11. 26-33 19-18 12. 21-26 1:0

Example 5

Pyramid

This game is similar to Halma, but here pieces may not move vertically. Pieces may only move diagonally. They may also move backwards. There is no capturing. Jumping is allowed. Series of jumps are also permitted. Pieces that are jumped over may not be captured. Aim: To reach the opponent's starting position.

Diagram 15 shows a starting setup; below I offer a sample game that demonstrates the specific characteristics of this game on this board.

Sample game:

1. 11-23 21-15 2. 22-12 34-21-8 3. 23-18 8-14 4. 18-13 10-21-8-19-6 5. 4-11 27-21 6. 11-23 16-9 7. 28-22 21-8-19 8. 13-25 9-20-31 9. 12-2 14-24 10. 2-7 31-18-29 11. 22-12-2-14 19-30 12. 7-20-9 29-22 13. 23-35 24-18 14. 35-31 18-12 15. 9-16 22-28 16. 31-20-9 12-22 17. 14-20 15-8 18. 16-21 8-3 19. 25-15-27 3-7 20. 20-26 7-2 21. 26-16 2-12 16-10 12-5 23. 9-16 5-11 24. 21-34 11-4 25. 17-23 30-17 26. 23-18 17-11 27. 18-13 6-12 28. 13-19 12-17 0:1

Example 6

Checkers (Shashki)

A game for two players. The game is similar to star pyramid. Pieces may move only diagonally. Pieces may not move backwards. Jumping is allowed (as is jumping in series). If a player jumps over an opponent's piece, the piece or pieces that have been jumped over must be captured. If a player's pieces reach the topmost, or first, row, then the pieces are transformed into queens, which may move backwards. Aim: To capture all the opponent's pieces, or to create a position in which the opponent is unable to move. The game may also finish in a draw.

Diagram 16 shows a starting setup; below I offer a sample game that demonstrates the specific characteristics of this game on this board.

Sample game: (White moves first)

1. 17-23 21-15 2. 4-17-30 34-21-8 3. 30-24 8-14 4. 28-17-30-19-8-21-34D 10-21 5. 11-17 16-26 6. 17-30-19 21-32 7. 22-29 26-36 8. 29-18 32-37 9. 23-30 37-35 10. 30-37-32 1:0

Example 7

Triangles (merelles)

Each player has three pieces. The pieces may be placed on cells 1, 4, 6, 8, 10, 17, 21, 28, 30, 32, 34 or 37 (12 cells). The players place their pieces on the board in alternating order. After both players have placed all three of their pieces on the board they continue the game by jumping to the above-mentioned cells. The aim if the game is to form a triangle. (A player who is able to complete a triangle may remove one of the opponent's pieces). Triangles are formed by pieces placed on cells 1-6-8, 4-6-17, 17-28-30, 8-10-21, 21-34-32, and 32-30-37. The player left with only two pieces loses the game.

Diagram 17 shows a starting setup; below I offer a sample game that demonstrates the specific characteristics of this game on this board.

Sample game:

1. 34 32 2. 4 30 3. 37 17 4. 34-28 17-21 5. 4-34 30-8 6. 28-10 32-6 7. 37-1 8-17 8. 34-4 6-30 9. 1-28 17-32 0:1

As I worked on my invention, I recognized that various existing game-of-chance board games—such as lotto, roulette, dreidel, blackjack, and numerous roulette-like games such as (chess-) queen roulette, rook-bishop roulette, king-knight-two pawn roulette or lotto chess—can be adapted into new, enjoyable, board games using the novel, six-pointed star-shaped playing area, and by adapting the existing rules to the new playing area.

The game-of-chance inventions (II) are:

(chess-) queen roulette
rook-bishop roulette
king-knight-2 pawn roulette
lotto
lotto chess (TV and casino versions)
roulette
dreidel
blackjack.

In the above game-of-chance type games I have made certain modifications. The following differ from traditional roulette:

(a) the shape of the board
(b) to some extent the possibility of betting—for example, in this version "3, 5, 6 or 7 adjacent numbers" exist, while in traditional roulette such bets are not possible.

On the six-pointed star-shaped board, cell 37 is also 0 (denoted as 37=0).

In what follows I will explain and exemplify the design of the new board game inventions, and detail the relevant modified playing rules.

The game-of-chance type inventions can be played on the 37-cell Polgár Superstar® six-pointed star-shaped board as follows (examples 8 to 15).

(Chess-) queen roulette (double or nothing) (Example 8)

Each player (1-6) places their bet. Only one bet may be placed on any specific number. A number is drawn to which the queen is placed. The chess queen may move diagonally as well as vertically. If the betting chip is in the same diagonal or column, the player wins. If the chip is on the identical number as the queen, the player of course wins. 0=37, that is, 0 functions as any other number. The player determines the size of the bet. For example: The players place bets on cells 2, 6, 15, 19, 28 and 32, and the queen is drawn on 6, as shown in diagram 18. The winning bets are those placed on cells 2, 6, 19, 28 and 32, and the chip placed on cell 15 is lost. In the case of a winning chip, the player receives double the bet placed, while in the case of a losing chip, the bet is lost, on a double or nothing basis, as suggested by the name in brackets above.

Rook-bishop roulette (Example 9)

Each player (1-4) places two bets. A number is drawn to which the rook and the bishop move. The rook may move only vertically, and the bishop may move diagonally. If the betting chip is in the same column as the rook or the same diagonal as the bishop, the player wins. If the chip is on the identical number as the rook or the bishop, the player of course wins. 0=37, that is, 0 functions as any other number. The players determine the size of the bets.

King-knight-two pawn roulette (Example 10)

Each player (1-4) places two bets. Four numbers must be drawn, to which the king, knight and two pawns move. The king may move to any adjacent cells, the knight jumps as in chess, while the pawns move forward vertically and capture diagonally. If the betting chip is on any of the cells adjacent to the king, or may be captured by the knight or the pawns, the player wins. If the chip is on the identical number as the pieces and pawns, the player also of course wins. 0=37, that is, 0 functions as any other number. The players determine the size of the bets.

Lotto (Example 11)

The game may be played by two to four persons, or by one person using chips of four colors. Each player must place bets on seven numbers. Seven different numbers are drawn with the help of a roulette cylinder. The players choose the size of their bets. The amount they win depends on how many numbers they get right out of the seven. The relative winnings are illustrated in the table below.

| Number found | Winnings |
|---|---|
| 0 | Gets back the amount of the bet |
| 1 | Loses |
| 2 | Loses |
| 3 | Gets back double the bet placed |
| 4 | Gets back the bet placed + 5 times the bet |
| 5 | Gets back the bet placed + 100 times the bet |
| 6 | Gets back the bet placed + 5,000 times the bet |
| 7 | Gets back the bet placed + 100,000 times the bet |

Example: The player places chips on the following cells: 1, 10, 15, 18, 25, 29 and 35, as shown in Diagram 19. The numbers drawn using the roulette cylinder are 9, 15, 27, 29, 32 and 35. In this case the player has three winning bets: 9, 15 and 35. If, for example, the player's bet was 30 units, he or she gets this back plus another 30 units.

Lotto chess (TV and casino versions) (Example 12)

The position of the black and white major pieces on the baseline is randomly generated by a computer. The selection may also be made manually, using a special throwing die. The die features the image of the major pieces on each side (the sixth side being 0). When selecting using a die the pieces must be placed from left to right. In the event that the die shows a piece that has already been placed on the board, it must be thrown again. In the case of a television game, the game starts by placing money in a kitty, after which it is double or nothing until the player on the telephone (or in the studio) is willing to play. The duration of the chess game is limited (in the case of telephone calls to no more than two or three minutes). In any event, the challenger plays with the white pieces. His or her opponent is a computer (or a person). The challengers in the TV version may not lose money. In the casino version, however, they can. Of course, this game can also be televised. The pieces move according to the rules of Polgár Superstar® star chess. The game can also contain elements of logic.

Roulette (Example 13)

The betting and winning opportunities in this game are represented in diagram 20 as follows:

Multiple possibilities:

(a) one whole number 35×

(b) two adjacent numbers 17×

(c) three adjacent numbers 11×

(d) 5 adjacent numbers in columns or diagonals 6×

(e) 6 adjacent numbers in columns or diagonals 5×

(f) 7 adjacent numbers in columns or diagonals 4×

Simple possibilities:

(g) all red numbers 1×

(h) all black numbers 1×

(i) all even numbers 1×

(j) all odd numbers 1×

(k) all numbers between 1 and 18 1×

(l) all numbers between 19 and 36 1×

0 should be regarded as a whole number. If a player did not place any bets on 0, 37=0 loses and the bank wins, with the exception of the sum that any other player placed on 0.

Dreidel (Example 14)

Bets must be placed in the bank. (According to the agreement of the players—the bets can be in the form of sweets, nuts or money.) If the bank becomes empty it must be filled if the players wish to continue the game. If the bank is not divisible without a remainder, the remainder stays in the bank. The game is played with a die numbered 1, 2, 3, 10, 20 and 30. The aim of the game is to reach or approach cell number 37. Each player moves forward with one piece. If a player throws a number that would take him or her beyond the 37 cell, they must complete the move via cell 1. For example, if a player is on cell 31 and throws a 20, then the piece must end up on cell 14. (31+20−37=14). When moving forward 1, 2, 3, 10, 20 or 30 cells, if a piece ends up on a red cell the player must put into the bank an amount corresponding to the number of cells moved. If a piece lands on a black cell the player wins the corresponding amount.

Blackjack (Example 15)

The players place deposits in the bank, which, as the players agree, may take the form of sweets, nuts or coins. The game is played with a die numbered 1, 2, 3, 10, 20 and 30. Each player has one piece. Pieces move forward the number of cells shown on one throw of the die. The aim of the game is to reach or approach cell 37. If a player goes beyond cell number 7, the player must decide whether he or she wishes to make a further move. A player who goes beyond cell 37 loses. The winning player is the one whose piece reaches cell 37, or whose piece reaches the highest-numbered cell before 37. If a player whose piece was behind overtakes the others (from cell 8), the other players may take a further risk by throwing again. If all• players land on the same cell and no one wishes to thrown again, the game ends in a draw. If the players then wish to carry on playing, they must begin again from 1, or, if they do not wish to continue playing, the bets in the bank are divided in equal proportions. The players place equal bets and the winner takes all.

In order to play and teach the invented games, computer experts have developed programs, in accordance with the inventor's instructions. These programs have been carefully tested by the inventor. The programs are under continuous development, while users' manuals and guides are also being compiled. The computer programs and users' guides developed for playing and teaching the invented games are the property of Dr. László Polgár. In the course of the patenting process the inventor will, on request, submit these programs and/or users' guides to the Patent Office. The above-mentioned computer programs are protected by copyright (©).

In the modern world, time, money and the avoidance of long absences from home and long-term stress are all very important. Stress is a factor not only during individual games but also throughout the entire two or three weeks of a chess tournament. Experience shows that in the case of reform chess, games can be completed in one or two days, which is a distinct advantage when it comes to competition chess and tournaments. This advantage is perfectly illustrated at Polgár Superstar® star chess competitions. At amateur level, one advantage of our board game inventions is that one can easily find time to play a game or solve a puzzle at home, while performing other activities, or while travelling. This game is particularly recommended for long airplane or train journeys.

As a result, the board games that can be played on the Polgár Superstar® six-pointed star-shaped board are particularly suitable for educational purposes, with special respect to developing creativity. Since they are easy and fast to play, they are perfect for televising and also suitable for chess instruction and for competitions and contests. Thrilling live chess demonstrations can be staged in theatres or outdoors. Experience shows that Polgár Superstar® star chess is easier to teach, to learn, and to play than traditional chess. With the development of computer programs this game will open up new horizons in the modern world of chess computers and chess software. Since it is easy to teach and play, and since the combinative opportunities are far greater than in traditional chess, it provides a unique opportunity for the development of combinative abilities and creativity. The game is more interesting and entertaining than traditional chess, and can even be televised live, in the form of game displays, test matches, puzzle competitions, and so-called four-handed double and mixed-double games. There are excellent opportunities to play the games on the Internet, by telephone, on mobile phones, or against computer software and mini-chess computers, which can easily popularize these modern games.

The above considerations, mutatis mutandis, are also valid for the game-of-chance inventions.

In summary, it can be stated that the board game inventions have many attractive features that can create favorable conditions for the spread of the games, with the expectation of financial success.

Additional Embodiments of the Present Invention

As shown in FIGS. 21-43, the present invention may be embodied in a multitude of other ways, depending upon the board and specific game selected.

A variety of boards may be used, including a 6×6 square, 5×7 rectangle, or a 37-cell six-pointed star-shaped board (with hexagonal cells). To play roulette on the 6×6 board, in addition to the 36 cells there are 0 and 00 cells, as well as red and black, odd and even, 1 to 18 and 19 to 36 playing areas (this also is the case with the 5×7 board).

The following games can be played on the boards: Chess, Halma, Pyramid, Checkers (Shashki), Horse Race, Pawn War, French Chess, Queen Roulette, Rook-Bishop Roulette, King+Knight+2 Pawns Roulette, Lottery, Lottery Chess, Roulette, Black Jack and Dreidel.

The games are fast, dynamic, and highly enjoyable. The logical games are also ideal for developing creativity. They are also highly beneficial in the development of other abilities and skills.

In the chess game the major pieces can be positioned on the baseline in any order. Thus on the 6×6 board there are 64,800 different setups, while on the star-shaped board and the 5×7 board there are a total of 7,200 varieties.

The games also may be embodied as computer programs, as well as on-line and television versions.

Figure 21:
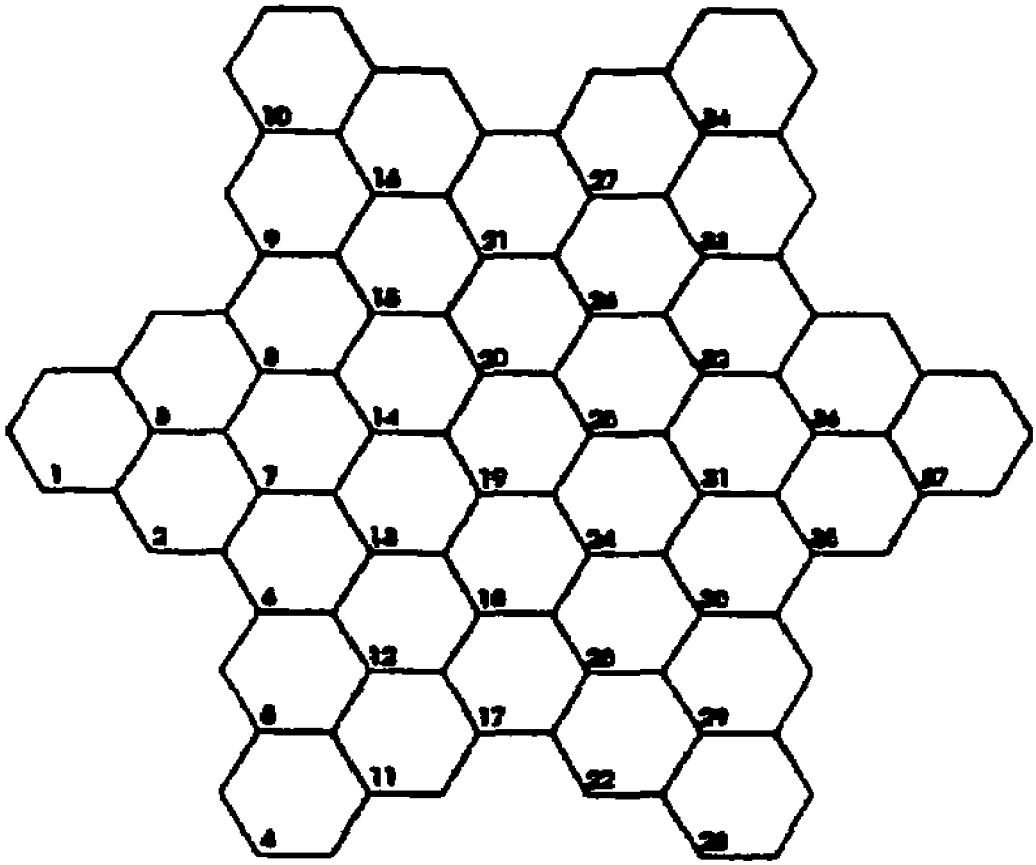
FIGS. 21-43 show playing areas of other embodiments of the present invention.
Figure 22:
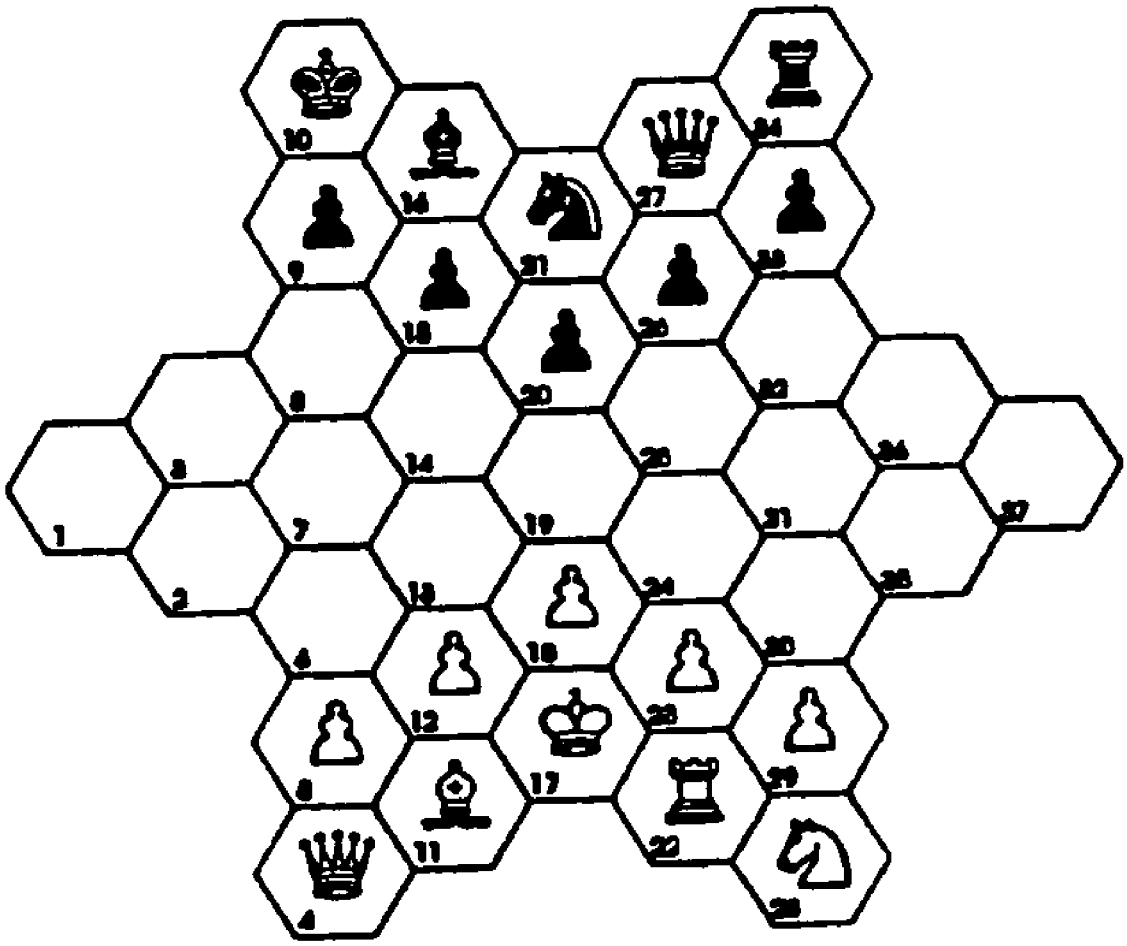

The advantages of the games of the present invention include:

Faster (fewer cells make for a more dynamic game)
More interesting (more combination of options)
Easy to televise (because of shorter games)
Easy to teach
Suitable for any age
Excellent for developing creativity and logical thought
In one of the menus of star chess the game of logic can be connected with the elements of a game of chance. This option makes the game unique among its kind. Of course, these games are more than games. They are a science and an art as well. They are excellent tools for education. They can also be used for both diagnosis and therapy. Feelings of success or failure can also develop the personality.
They can be played on a computer, on the Internet, on a mobile phone and other personal digital assistants and devices.
There are competitions which attract huge interest.
Polgár Superstar:
Six-pointed star-shaped board—novelty, originality
Chess:
The board comprises 37 hexagonal cells, rather than black and white squares.
Such combinations of moves do not exist in other games.
There is no en passant or castling.
The cells are denoted simply by numbers rather than by letters and numbers.
Major pieces: 2×(1 queen, 1 rook, 1 king, 1 knight, 1 bishop)
Number of pawns: 5 each
The major pieces are positioned as desired on the baseline. (Altogether there are 7,200 different setups)
Shashki/Russian Checkers
Differs from checkers in as much as the board comprises hexagonal cells.
The setup and movement of the pieces also differ.
There is a different number of pieces.
This embodiment is shown in FIG. 21.
Code System—Key to Symbols
Each Square can be denoted by a number. Keeping score:
The move number, plus the symbol or letter of the piece (except for pawns), plus the number of the square where the piece comes from, plus a dash, plus the number of the square where the move or capture takes place.
Where the move or capture takes place.
For example: 10.♘22-19 ♖21-20
In case of black's move: 12.-♕3-29 (in place of white's move we use a dash)
For pawns: 1.29-31 33-32
=draw (½)
+− white has a decisive advantage (1:0)
−+ black has a decisive advantage (0:1)
? a mistake
?? a blunder
! a very good move
!! an excellent move
# mate
The starting position
A possible starting position
The pieces stand in the lowest (4, 11, 17, 22, 28) and the highest (10, 16, 21, 27, 34) squares. The pawns are in front of the pieces. The players then take it in turns to place on piece anywhere on the starting row until all the pieces are positioned. One's cannot capture one's own pieces.
This embodiment is shown in FIG. 22.
The King
The king may move one square in any direction, so long as no piece is blocking its patch. The king can capture in any direction. The king is the only piece that cannot be taken. The king may not move to a square:
occupied by one of his pieces, where it is checked by an enemy piece, adjacent to the enemy king (castling is not possible)

Figure 23:
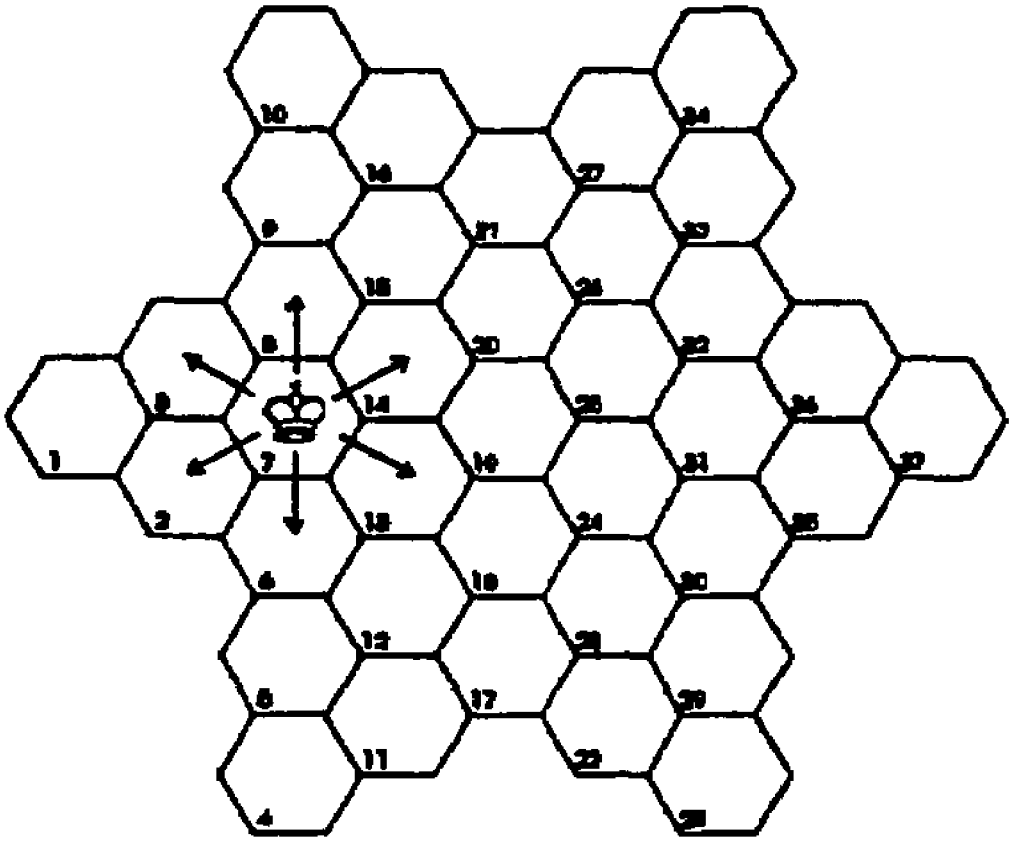

This embodiment is shown in FIG. 23.

The Pawn

The pawn on its first move may move either one or two squares forwards. The pawn after the first move may only advance one square at a time. The pawn captures by moving diagonally one square forwards, either to the left or the right. The pawn way not move or capture backwards. If two pawns oppose each other on adjacent squares, then neither pawn can move. Likewise, if any piece (one's own or the opponent's) stands in front of a pawn, the pawn can't move. The pawns can only reach the squares 1, 2, 3, 35, 36 and 37 by capturing. If a pawn reaches the lowest (or highest) rank, it must be exchanged for a piece. Pawn promotion: if a pawn reaches the last (or first) row of the board, it must be exchanged.

It can be exchanged for:

1., queen

2., knight

3., rook

4., bishop of its own colour. But never for a king! If you still have your original queen, you might have a new queen as well.

There is no en passant in this game.

Figure 24:
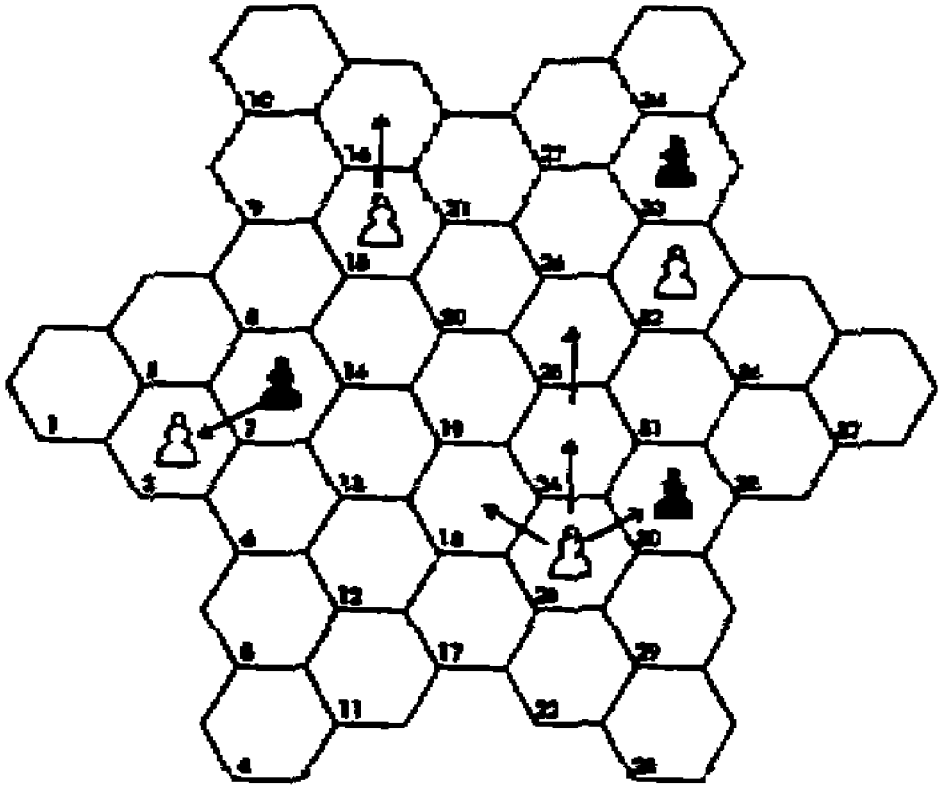

This embodiment is shown in FIG. 24.

The Rook

The rook may move any number of squares only vertically, so long as no piece is blocking its path. It can take the opponent's pieces that are in the way. The rook can never go to the squares 1, 2, 3, 35, 36 and 37. The rook can only give mate to the opponent's king in exceptional cases.

Figure 25:
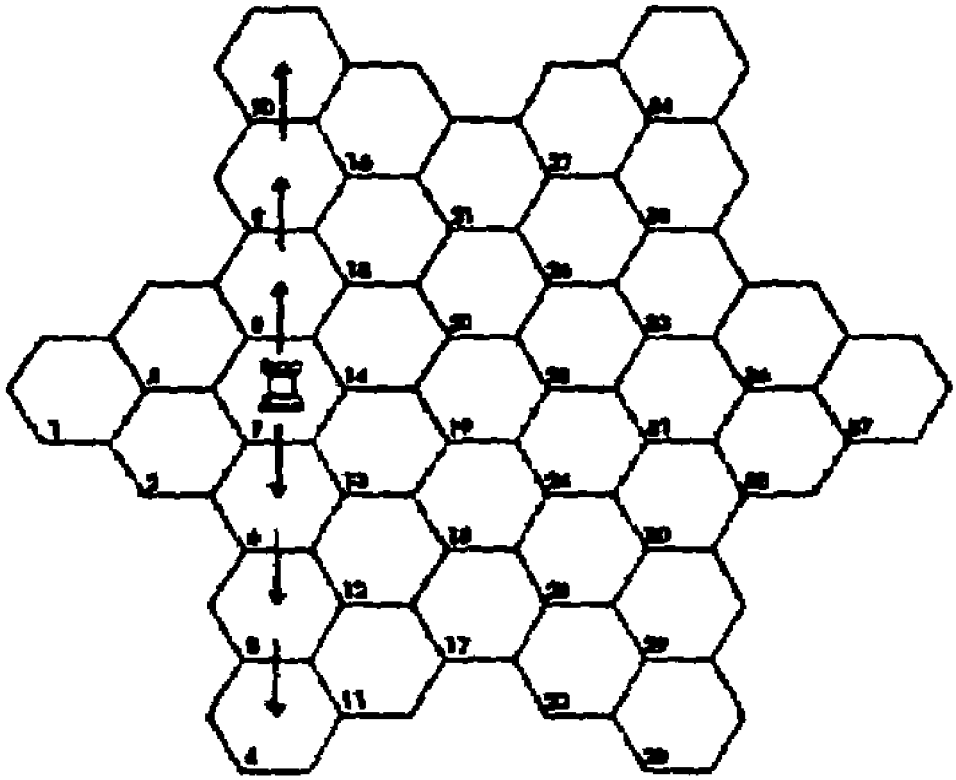

This embodiment is shown in FIG. 25.

The Bishop

The bishop may move any number of squares diagonally, backwards or forwards, so long as no piece is blocking its path. It can take the opponent's pieces that are in the way.

Figure 26:
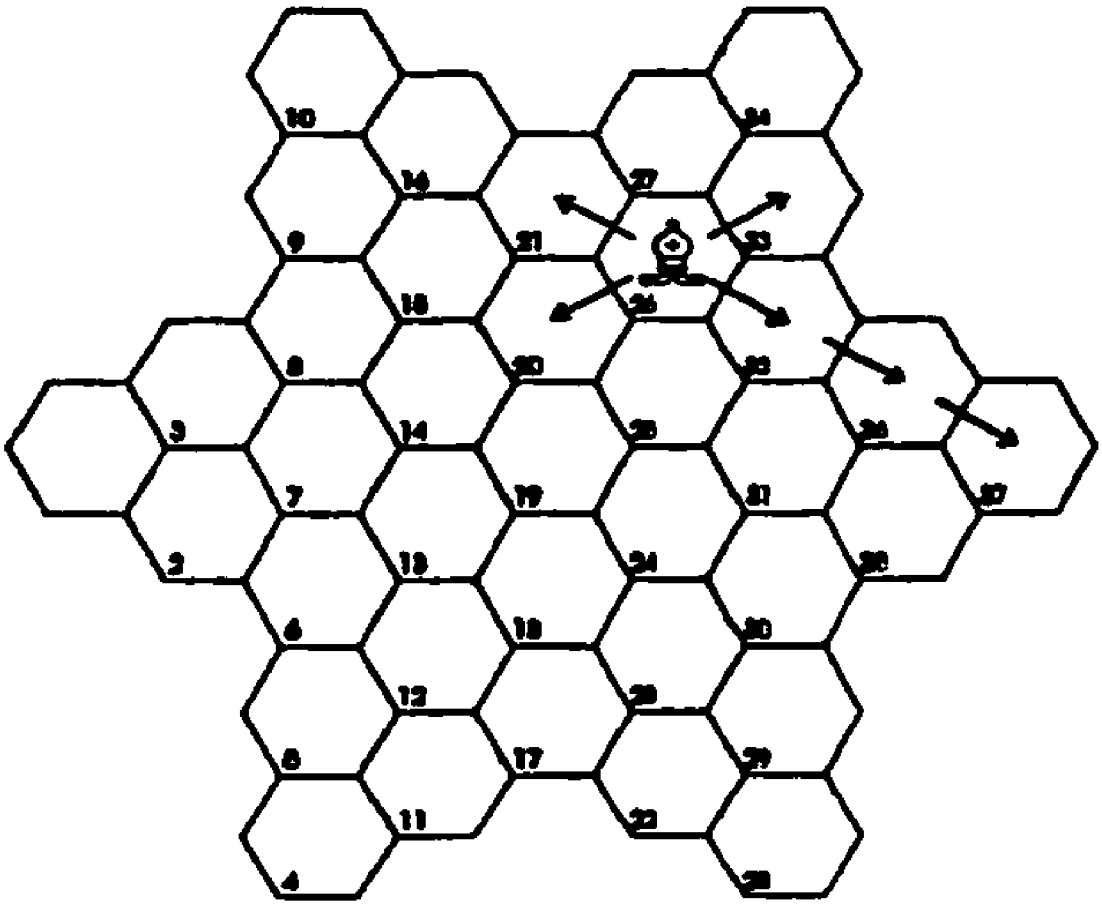

This embodiment is shown in FIG. 26.

The Queen

The queen may move any number of squares in any direction, so long as no piece is blocking its path. But it cannot move as a knight (it can move like a king, rook or bishop.) It can take the opponent's pieces that are in the way. The queen cannot move horizontally.

Figure 27:
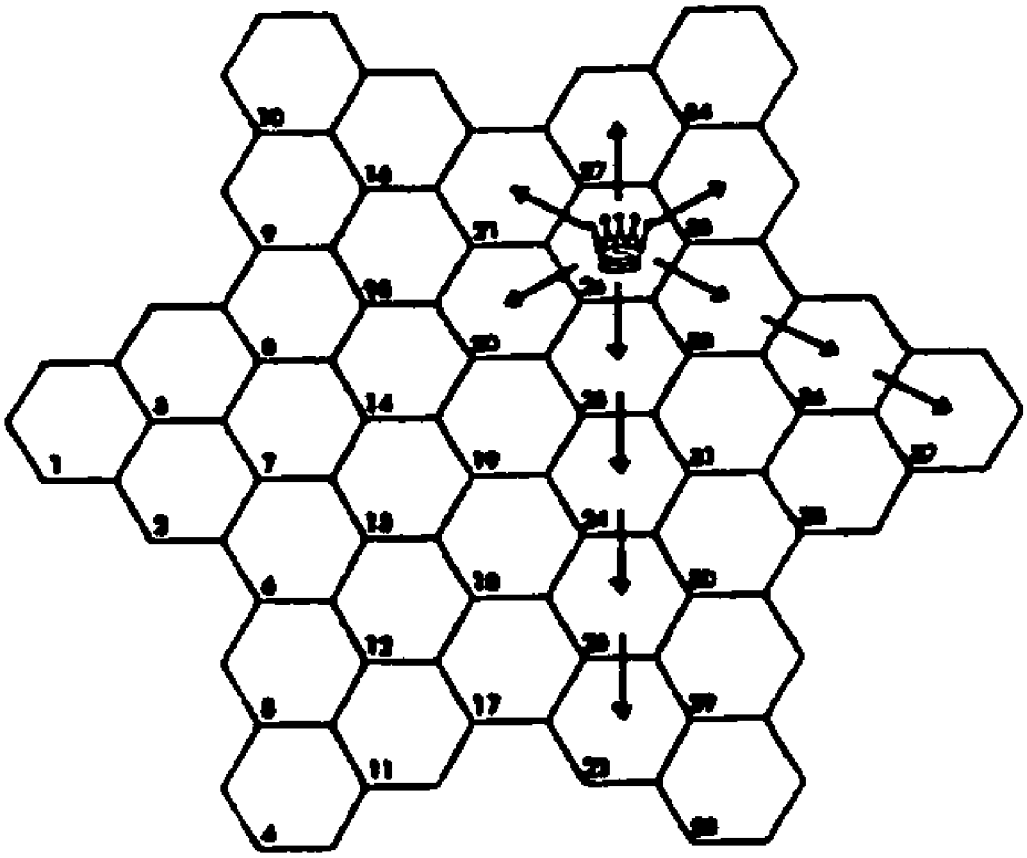

This embodiment is shown in FIG. 27.

The Knight

The knight may leap to any square (and can capture on that square) in the way shown in the diagram. It is the only piece which may jump over a piece in its way. (in this game, the knight is a much stronger piece than in traditional chess. Here the knight is capable of gaining a tempo as well)

Figure 28:
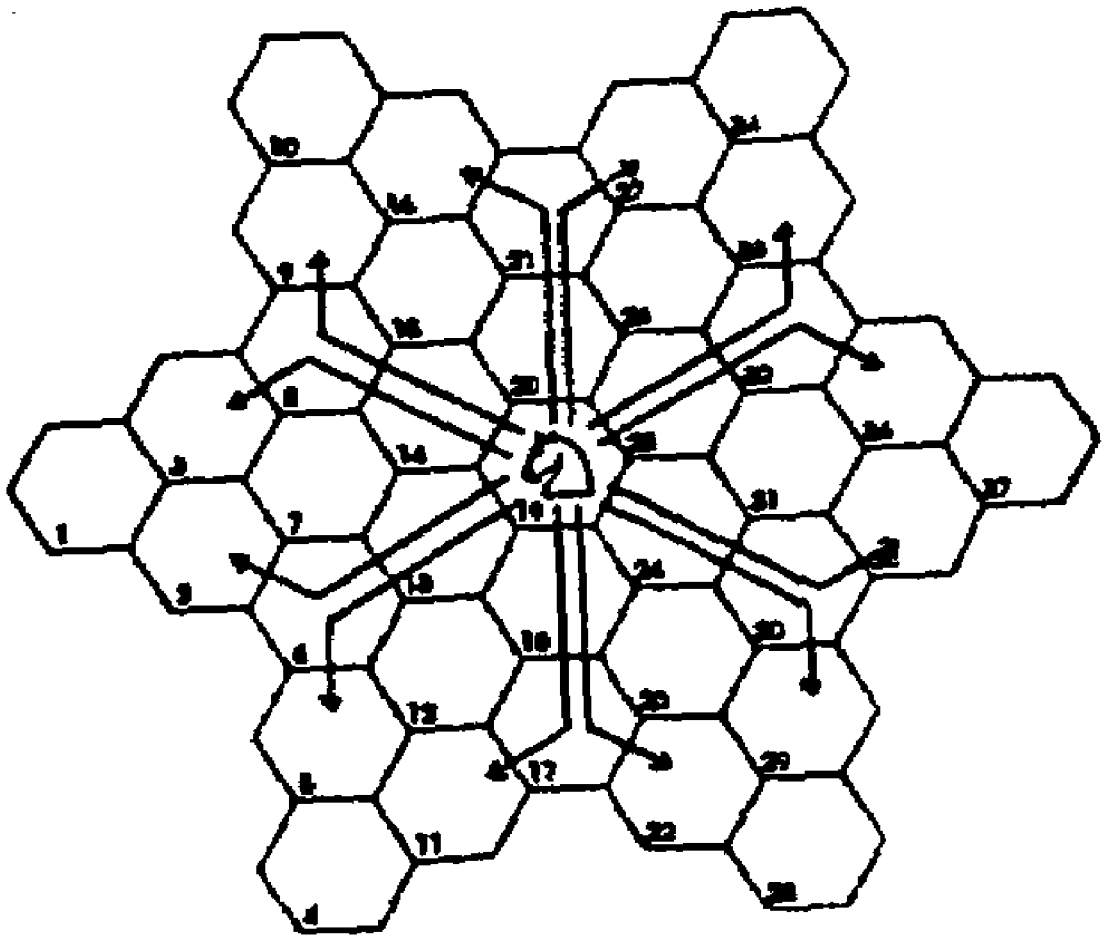

This embodiment is shown in FIG. 28.

Check-checkmate-stalemate

Check: a king is in check if it is attacked by an opposing piece.

A king can never be captured. A king must get out of check immediately by moving the king, or by capturing the opposing piece, or by interposing a friendly piece to block the check.

If a knight is giving check we cannot interpose a piece to defend. In case of double check we cannot interpose a piece to defend.

Mate: if the king cannot escape from check, this position checkmate.

Stalemate: if the king cannot move and it is not checkmate, and the player whose turn it is cannot move any other piece, the game ends in a draw by stalemate. The king, queen, bishop and knight is each alone capable of stalemating the opponent's king if it is in the corner. (The rook however, cannot)

A draw occurs if:

1., stalemate

2., if only two kings remain on the board

3., perpetual check

4., three-fold repetition of moves,

5., if, towards the end of the game, the position is clearly drawn, the two players can agree to a draw.

Figure 29A:
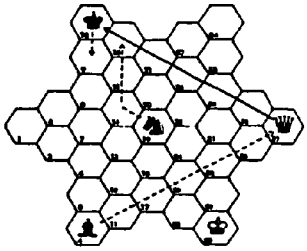
Figure 29B:
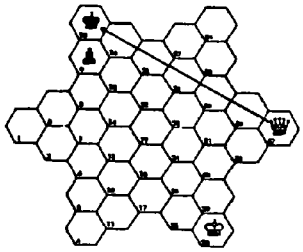
Figure 29C:
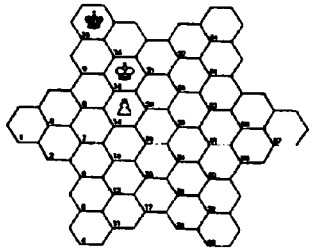

This embodiment is shown in FIGS. 29A, 29B, and 29C.

Lottery Chess (Lotchess) TV and casino versions

Superstar Chess

The position of the black and white major pieces on the baseline is randomly generated by computer. The selection can also be made manually, using a special throwing die featuring the image of the major pieces on each side (the sixth side being 0). When selecting using a die the pieces must be placed from left to right. In the event that the die shows a piece that has already been placed on the board, it must be thrown again.

In the case of a television game, the game starts by placing money in a kitty, then it is double or nothing until the player on the phone (or in the studio) is willing to play. The time of the chess game is limited (in the case of phone calls to no more than 2 or 3 minutes). In any event, the challenging player plays with the white pieces. His or her opponent may be a computer (but also a person). The challengers in the TV version cannot lose money. In the casino version, however, they can. Of course, this can also be televised. The pieces move according to the rules of star chess (see description under Polgár Superstar Chess).

Superstar Pawn War

A game for two players

A king and 2 to 5 pawns of each color (the number may be decided by die) are placed on the board. In the initial setup pawns may not be placed on cells 4, 11, 17, 22, 28 and 10, 16, 21, 27, 34. The kings may be placed anywhere on the board (but not in a check position). If a player's pawn reaches the opponent's baseline then the pawn must be promoted into a queen, rook, knight or bishop.

Aim: to checkmate the opponent's king. The game can also finish in a draw.

The rules are identical to those of Polgár Superstar Chess. This game is highly suitable as an introduction to star chess for both beginners and small children.

Figure 30:
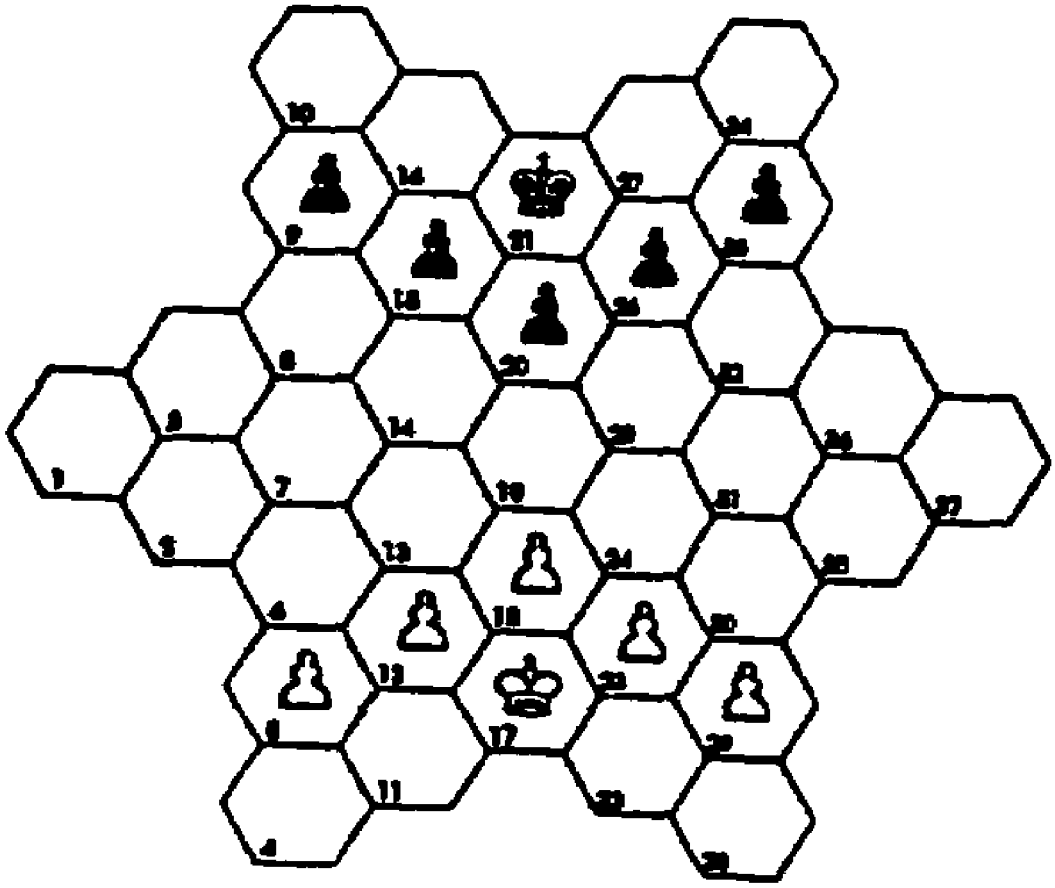

This embodiment is shown in FIG. 30.

1. 23-24 9-7 2. ♔17-23 15-13 3. ♔23-30 ♔21-15 4. ♔30-31 7-6 5. 18-13 ♔15-14 6. 24-25 (6. 12-6 20-18 0:1) ♔14-13 7. ♔31-24 6-12 8. 5-12 20-19 0:1

Superstar Horse Race

Instead of pieces and pawns, only knights are placed on the base line. The knights move according to the rule of star-shaped chess (Polgár Superstar chess, see description there).

Capturing is possible.

Aim: To take over the opponent's starting position. The winner may not finish with fewer knights on the board.

Figure 31:
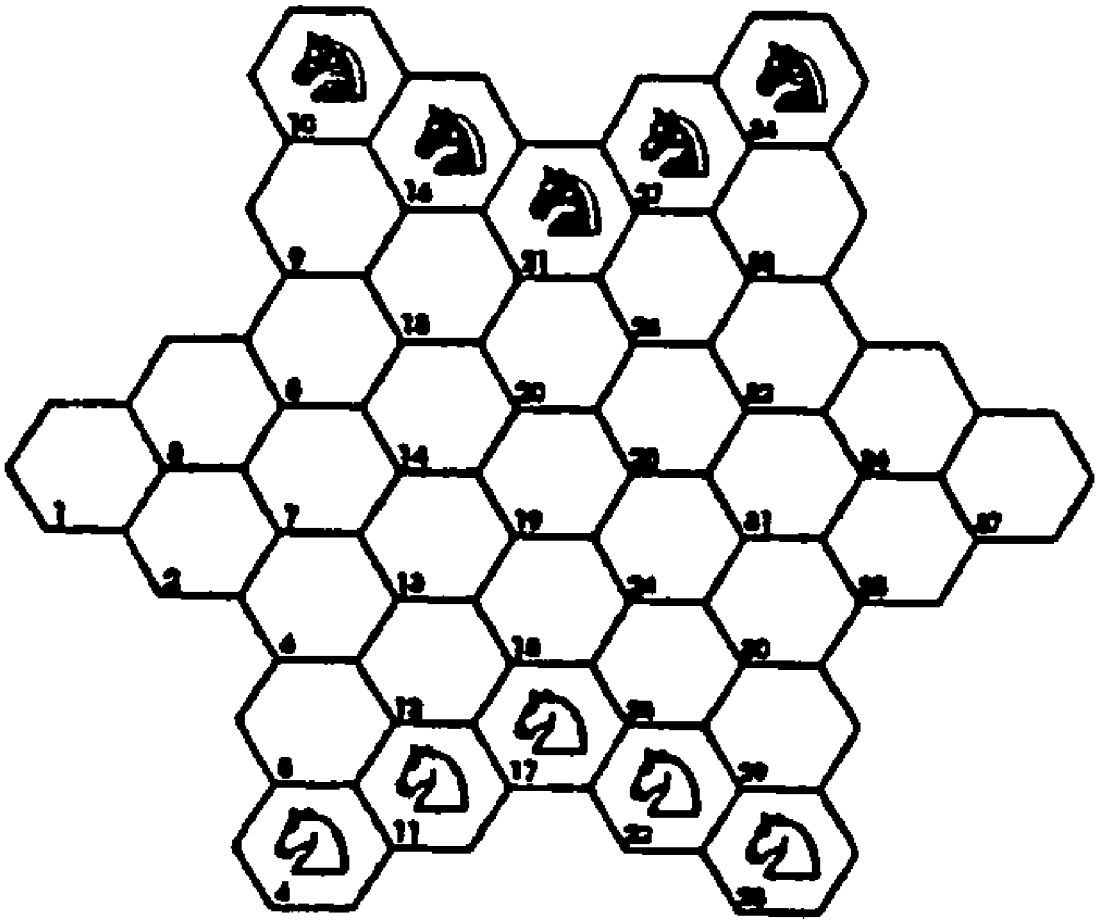

This embodiment is shown in FIG. 31.

1. ♘28-24 ♘34-20 2. ♘4-13 ♘21-24 3. ♘11-24 ♘10-3 4. ♘22-35 ♘3-5 5. ♘35-26 ♘27-36 6. ♘17-31 ♘20-12 7. ♘24-21 ♘12-25 8. ♘13-9 ♘25-17 9. ♘31-27 ♘36-27 10. ♘9-27 ♘5-22 11. ♘26-13 ♘22-13 12. ♘21-13 ♘16-7 13. ♘27-19 ♘7-24 0:1

French Superstar Chess

A game for two players

The major pieces are placed on the bottom (4, 11, 17, 22, 28) and top lines (10, 16, 21, 27, 34).

To start, the players place the major pieces (king, queen, rook, bishop, knight) individually, in alternating order. The pawns are placed in front of the other pieces. A player may not capture his or her own pieces. The pieces move according to the rules of Polgár Superstar Chess (see description). Pawn promotion is possible. Exception: The king can move into check and the king can be taken. If a player cannot move. then the opposing pawns change places, and this counts as a move.

Aim: to have all one's pieces captured. If neither player can move, the game ends in a draw.

The game also ends in a draw if one side is unable to sacrifice a piece.

Figure 32:
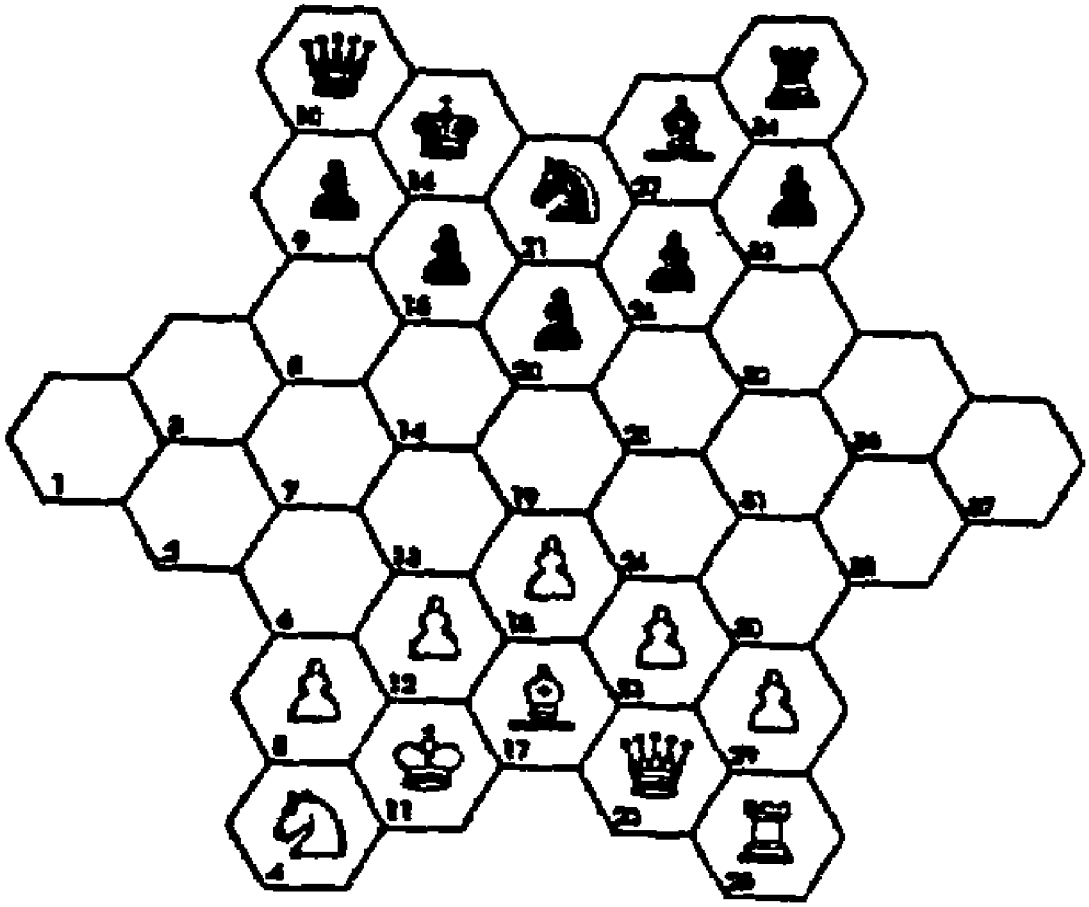

This embodiment is shown in FIG. 32.

1. 23-25 20-25 2. ♕22-25 15-13 3. ♕25-9 ♕10-9 4. ♘4-13 ♕9-5 5. ♔11-5 ♘21-13 6. 18-13 ♘27-1 7. 13-14 ♘1-12 8. ♔5-12 ♔16-10 9. ♔12-13 26-24 10. ♘17-30 24-30 11. ♔13-19 33-31 12. ♔19-20 ♔10-9 13. 14-15 ♔9-15 14. ♔20-15 ♖34-32 15. ♔15-20 ♖32-34 16. ♔20-19 ♖34-32 17. ♔19-25 ♖32-34 18. ♔25-32 ♖34-32 19. 29-30 (csere!)♖32-34 20. ♖28-29 ♖34-32 dontetlen/1;2:/1;2

Halma Superstar

A game for two or four players.

Requires four pieces for each player. The pieces can move vertically and diagonally. There is no capturing. Jumping is allowed (as is jumping in series). Pieces may also move backwards. Pieces that are jumped over may not be captured.

Aim: To occupy, by moving diagonally, the starting positions of the opposing pieces. The player who is first to occupy the opponent's cells is the winner. A player must leave his or her own starting cells in seven moves). The game is similar to Pyramid, but here pieces can also move vertically.

Figure 33:
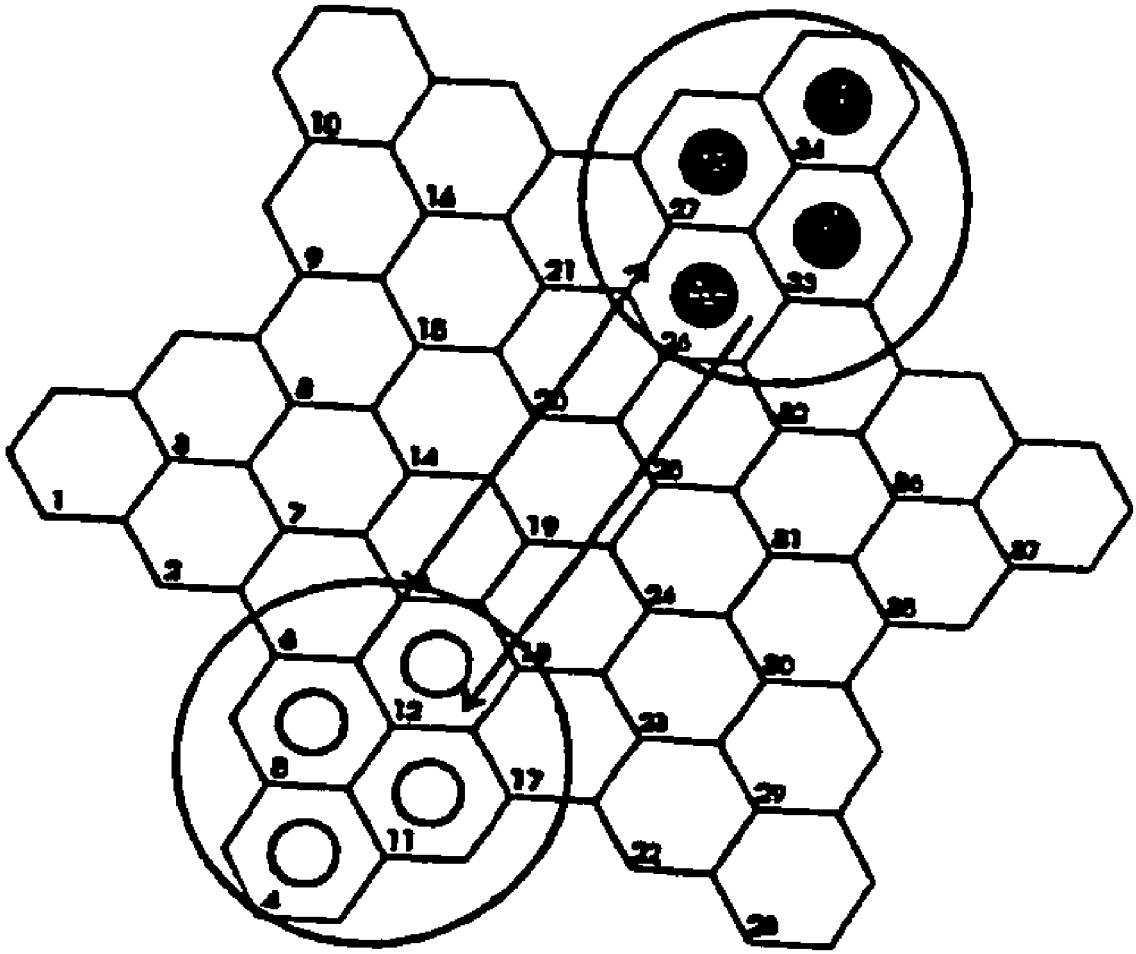

This embodiment is shown in FIG. 33.

4, 5, 11, 12 33, 34, 26, 27 1. 12-18 33-20 2. 4-17-19-21 27-25 3. 11-17 26-24-12 4. 17-19-32 12-11 5. 5-12 34-33 6. 32-34 33-32 7. 12-24-26 32-19-17-1 8. 18-24 25-19 9. 24-25 20-18 10. 25-27 18-12 11. 26-33 19-18 12. 21-26 1:0

Superstar Pyramid

This game is similar to Halma, but pieces may not move vertically. Pieces can move only diagonally. They may move backwards. There is no capturing. Jumping is allowed, and series of jumps are also permitted. Pieces that are jumped over may not be taken.

Aim: to reach the opponent's starting position.

Figure 34:
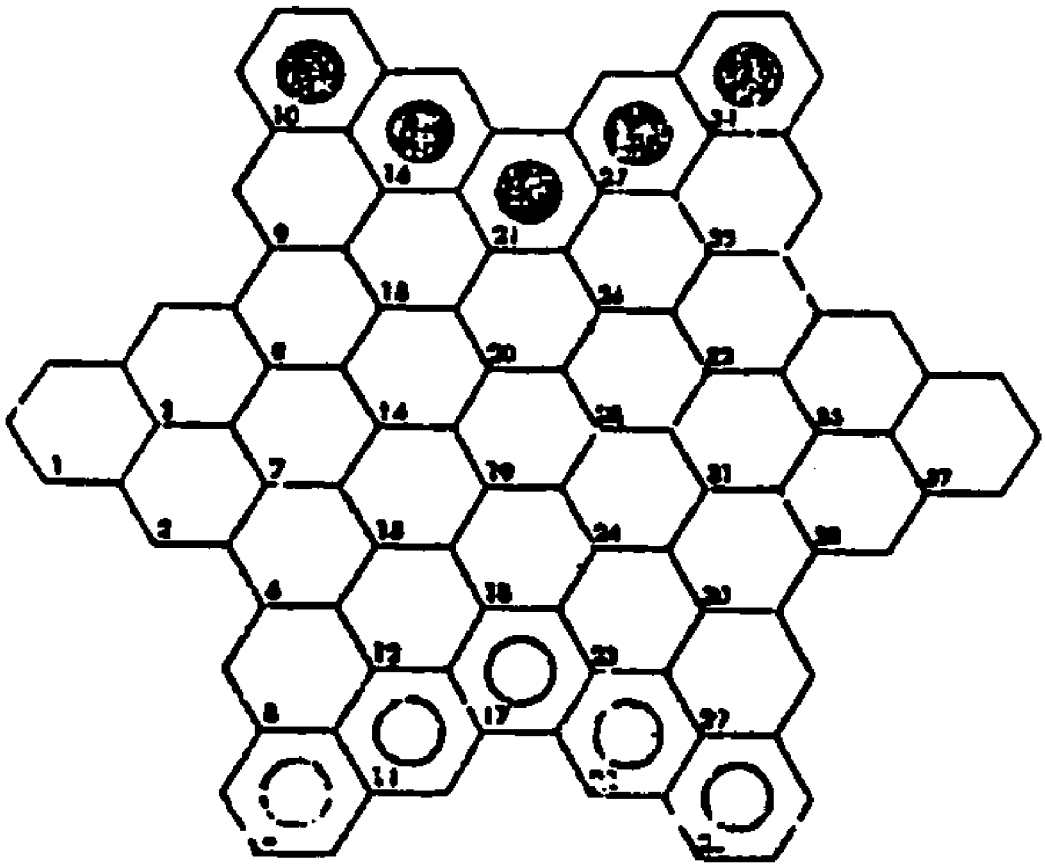

This embodiment is shown in FIG. 34.

1. 11-23 21-15 2. 22-12 34-21-8 3. 23-18 8-14 4. 18-13 10-21-8-19-6 5. 4-11 27-21 6. 11-23 16-9 7. 28-22 21-8-19 8. 13-25 9-20-31 9. 12-2 14-24 10. 2-7 31-18-29 11. 22-12-2-14 19-30 12. 7-20-9 29-22 13. 23-35 24-18 14. 35-31 18-12 15. 9-16 22-28 16. 31-20-9 12-22 17. 14-20 15-8 18. 16-21 8-3 19. 25-15-27 3-7 20. 20-26 7-2 21. 26-16 2-12 16-10 12-5 23. 9-16 5-11 24. 21-34 11-4 25. 17-23 30-17 26. 23-18 17-11 27. 18-13 6-12 28. 13-19 12-17 0:1

Superstar Shashki (Checkers)

The game is similar to Superstar Pyramid. Pieces can move only diagonally. Pieces may not move backwards. Jumping is allowed, and series of jumps are also permitted. If a player jumps over an opponent's piece, the piece or pieces that have been jumped over must be captured. If a player's pieces reach the topmost, or first, row, then the pieces are transformed into queens, which are far more powerful pieces. See description below.

Aim: To capture all the opponent's pieces, or to create a position in which the opponent is unable to move. A draw is possible.

A sample game for two players.

Sample game, white starts.

The queen's moves: If a piece reaches the opponent's baseline (cells 4, 11, 17, 22, 28 or 10, 16, 21, 27, 34), then the piece is promoted into a queen. The queen can move diagonally forwards and backwards and can take, not only if the opponent's piece is situated immediately next to it, but also if there are several cells between the queen and the opposing piece. After capturing, the queen may land not only immediately next to the captured piece but also on any free cell behind that piece. In the diagram, the white queen on cell 21 may capture the black piece on cell 8 and land on either cell 3 or cell 1. Two adjacent pieces may not be captured as they protect each other. For example, the queen in the diagram on cell 21 may not capture the black piece on cell 32 because there is no free space behind it, since it is occupied by the black piece on cell 36. (It might also be a white piece.) The queen may not capture the piece on cell 36, because the piece on 32 is standing in front of it.

Figure 35:
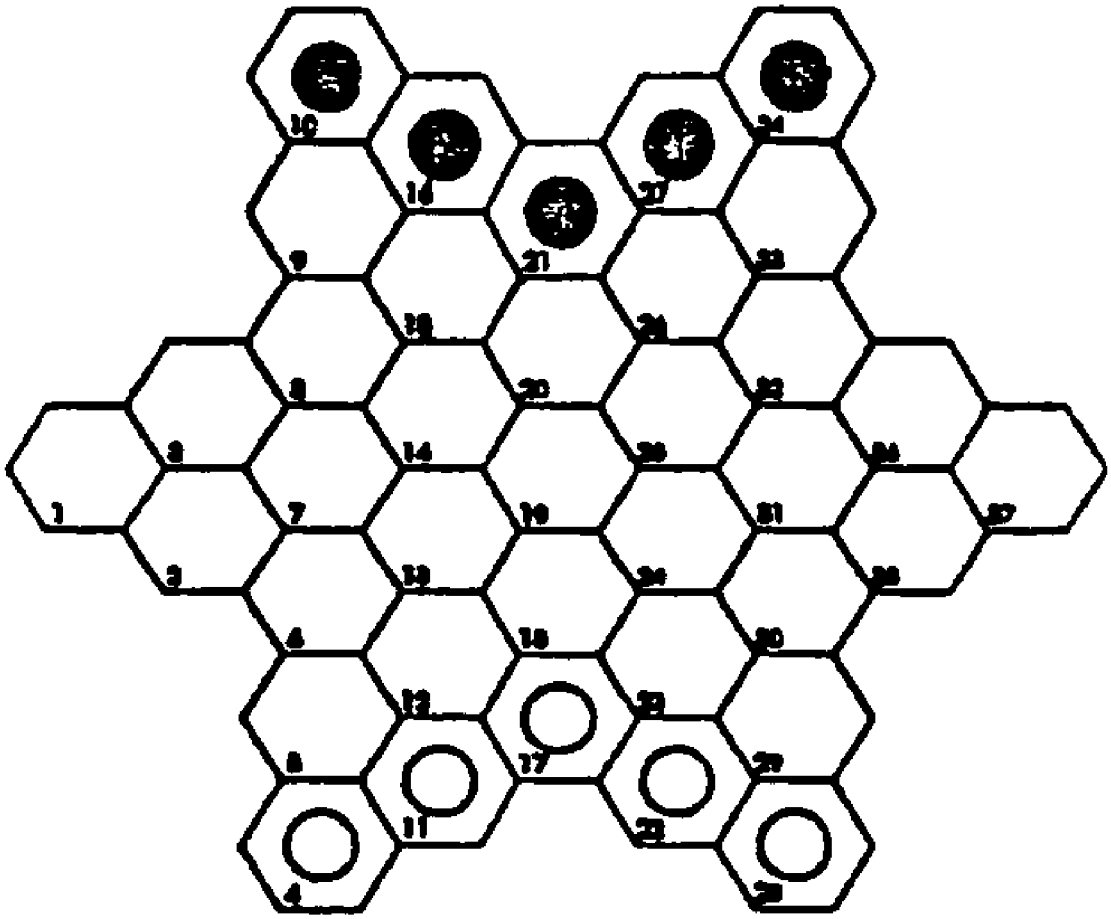

This embodiment is shown in FIG. 35.

1. 17-23 21-15 2. 4-17-30 34-21-8 3. 30-24 8-14 4. 28-17-30-19-8-21-34D 10-21 5. 11-17 16-26 6. 17-30-19 21-32 7. 22-29 26-36 8. 29-18 32-37 9. 23-30 37-35 10. 30-37-32 1:0

Superstar Triangles (Merelles)

A game for two players.

Each player has three pieces.

The pieces can be placed on cells 1, 4, 6, 8, 10, 17, 21, 28, 30, 32, 34 or 37 (12 cells). The players place their pieces on the board in alternating order. After both players have placed all three of their pieces on the board they continue the game by jumping to the above-mentioned cells. (See diagram for an example of a triangle)

Aim: to form a triangle. (A player who is able to complete a triangle can remove one of the opponent' pieces.) The player left with only two pieces loses the game.

Pieces on 1-6-8, 4-6-17, 17-28-30, 8-10-21, 21-34-32, 32-30-37 can form a triangle.

Figure 36:
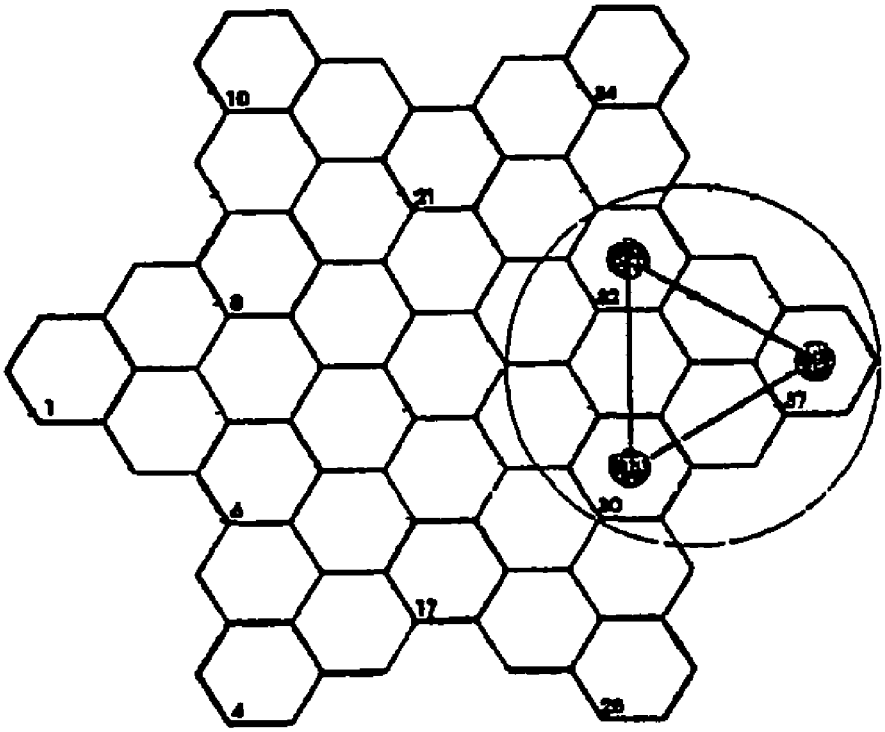

This embodiment is shown in FIG. 36.

1. 34 32 2. 4 30 3. 37 17 4. 34-28 17-21 5. 4-34 30-8 6. 28-10 32-6 7. 37-18-17 8. 34-4 6-30 9. 1-28 17-32 0:1

Rook and Bishop Roulette, Superstar Chess

Each player (1-4) places two bets. A number is drawn to which the rook and the bishop will move. The rook can move only vertically, and the bishop can move diagonally: If the betting chip is in the same column as the rook or the same diagonal as the bishop, the player wins. If the chip is on the identical number as the rook or bishop, the player of course wins. 0=37, that is, 0 functions as any other number. The player determines the size of the bet.

For example: The players' bets are placed on cells 4, 13, 20, 24, 28, 29 and 36, and the draw places the rook on cell 27 and the bishop on cell 7, as seen in the diagram. Bets placed on cells 13, 20, 24 and 29 were won, and those on cells 4, 28, and 36 were lost.

In the case of a winning chip, the player receives double the bet, while in the case of a losing chip, the bet is lost.

Figure 37:
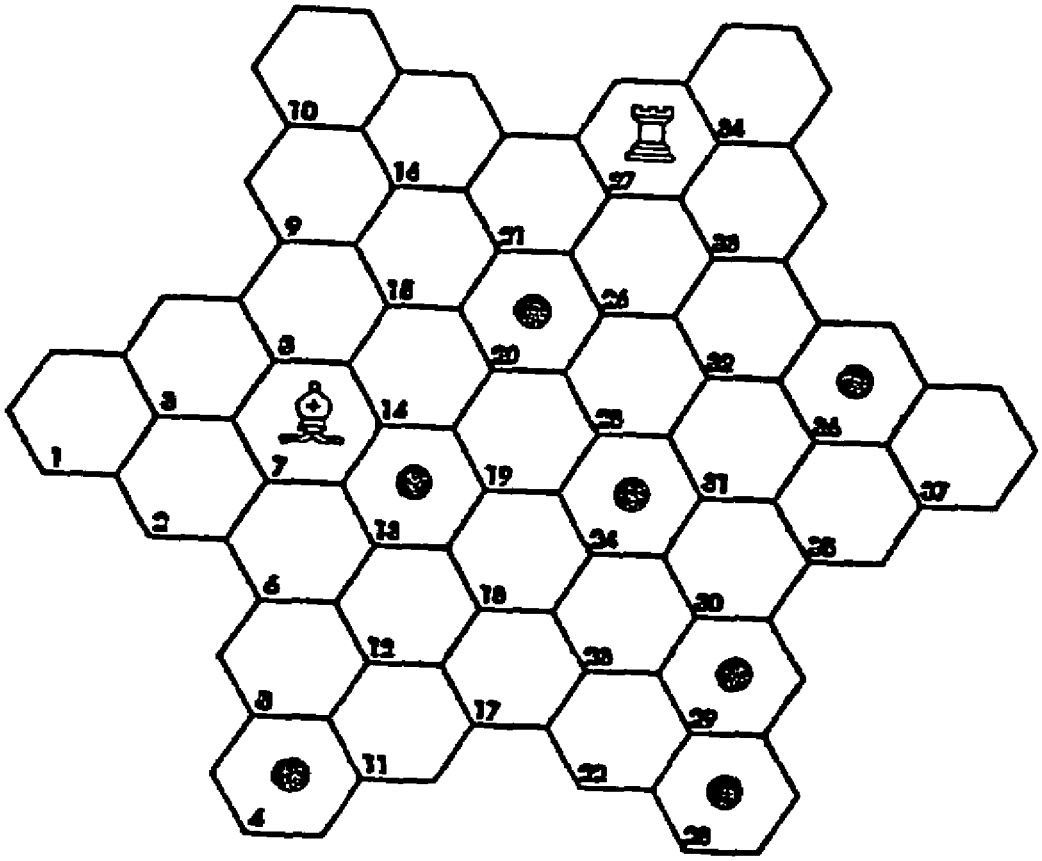

This embodiment is shown in FIG. 37.

Superstar Queen Roulette

Each player (1-4) places two bets. A number is drawn to which the queen will be placed. The chess queen can move diagonally as well as vertically. If the betting chip is in the same diagonal or column, the player wins. If the chip is on the identical number as the queen, the player of course wins. 0=37, that is, 0 functions as any other number. The player determines the size of the bet.

For example: The players place bets on cells 2, 6, 15, 19, 28 and 32, and the queen's number drawn is 6, as shown in the diagram. The winning bets are those placed on cells 2, 6, 19, 28 and 32, and the chip placed on cell 15 is lost.

In the case of a winning chip, the player receives double the bet placed, while in the case of a losing chip, the bet is lost.

Figure 38:
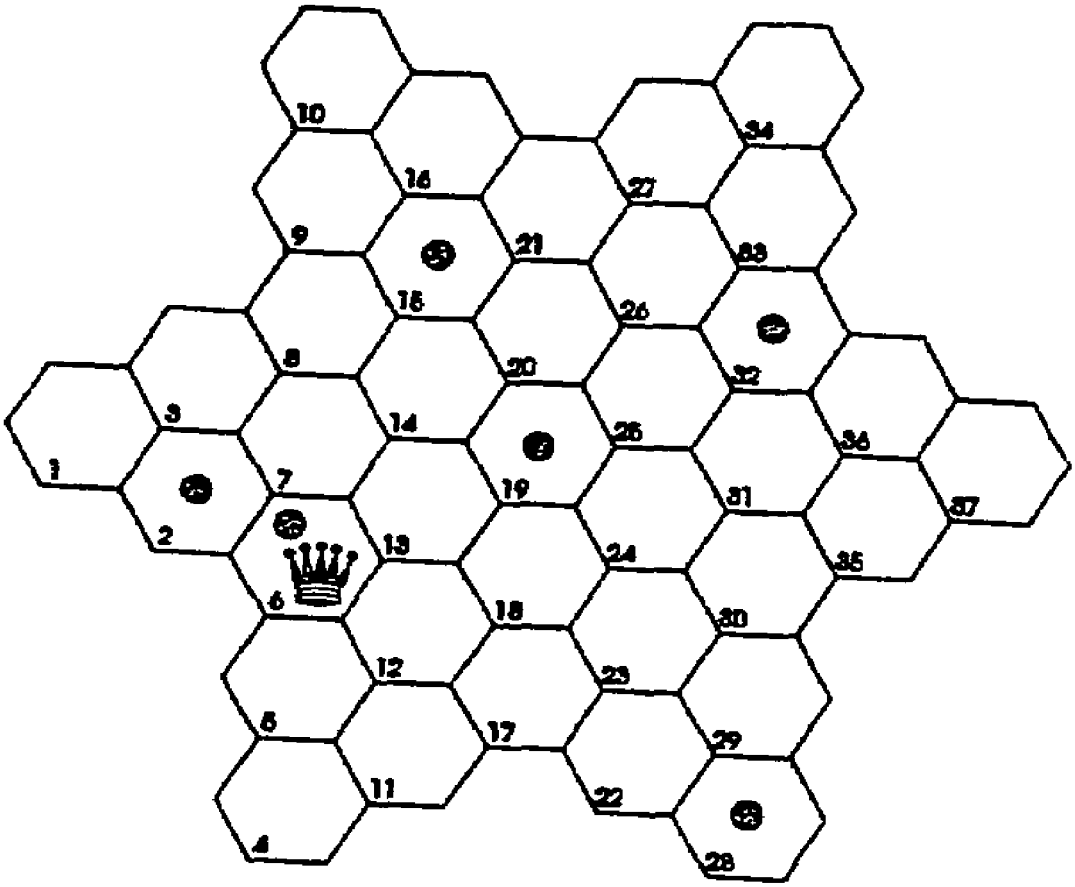

This embodiment is shown in FIG. 38.

King, knight, 2 pawn Roulette Superstar Chess

Each of the players (1-4) places two bets. Four number must be drawn on which the king, the knight, and the 2 pawns will move. The pieces and pawns move according to the rules of Superstar Chess (see description there). If the betting chip can be captured by the above pieces and pawns, the player wins. If the chip is on the identical number as the pieces and pawns, the player also of course wins. 0=37, that is, 0 functions as any other number. The player determines the size of the bet.

For example: The players place their bets on cells 4, 13, 20, 24, 28, 29 and 36, and the draw places the knight on cell 14, the king on cell 23, and the pawns on cells 20 and 31, as shown in the diagram. The winning bets are those placed on cells 20, 24, 29 and 36, while the chips placed on cells 4, 13 and 28 are lost. In the case of a winning chip, the player receives double the bet, while in the case of a losing chip, the bet is lost.

Figure 39:
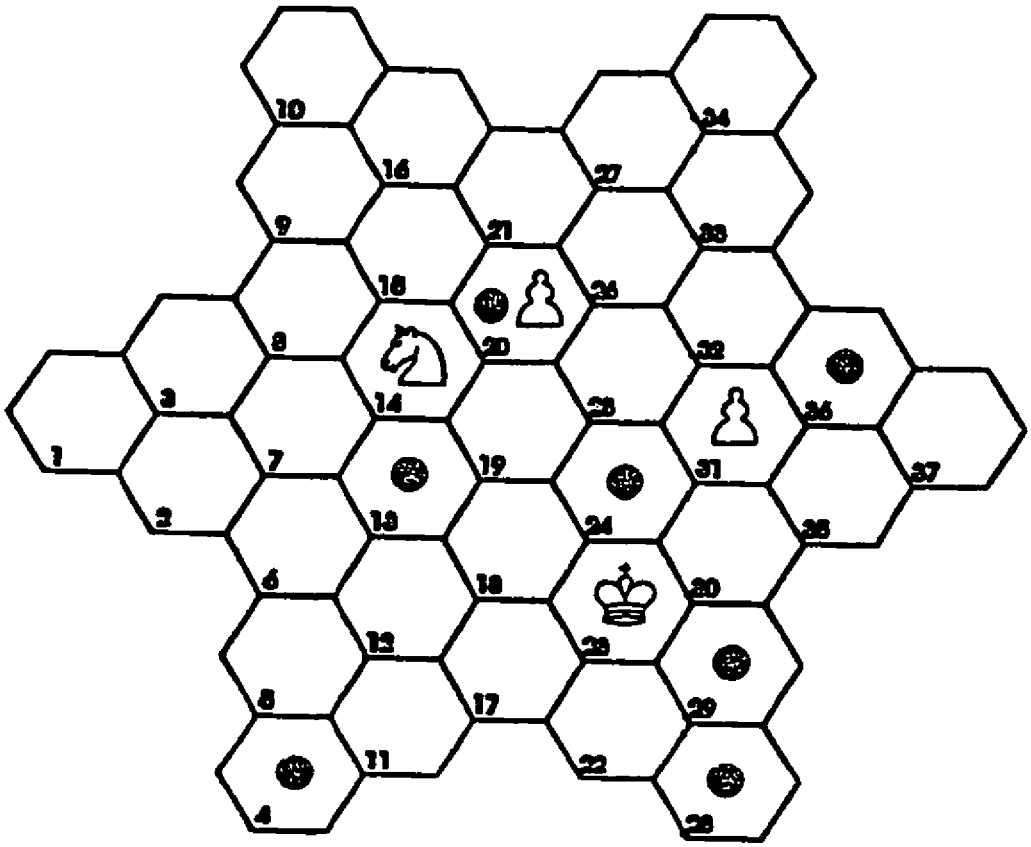

This embodiment is shown in FIG. 39.

Dice Dreidel on the six-pointed star-shaped board

Players can play for sweets, nuts, money, etc. Bets must be placed in the bank. If the bank becomes empty it must be filled, if the players wish to continue the game. If the bank is not divisible without a remainder, the remainder stays in the bank. The game is played with a die numbered 1, 2, 3, 10, 20 and 30. Players move one piece. If a player throws a number that would take him or her beyond the 37 (0) cell, they must complete the move via cell 1.

For example, if a player is on cell 31 and throws a 20, then the piece must be end up on cell 14 (31+20−37=14). When moving forward 1, 2, 3, 10, 20 or 30 cells, if a piece ends up on a red cell the player must put into the bank an amount corresponding to the number of cells moved, and if a piece lands on a black cell the player wins the corresponding amount. If a player lands on the 37(0) cell nothing is won or lost.

Dice Black-Jack on the six-pointed star-shaped board

Players can play for sweets, nuts, money, etc., with bets deposited in the bank. The game is played with a die numbered 1, 2, 3, 10, 20 and 30. Each player has one piece. Pieces move forward the number of cells shown on one throw of the die.

Aim: to reach or get near cell 37. If a player goes beyond cell number 7, the player must decide whether be or she wishes to make a move. A player who goes beyond cell 37 loses. The winning player is the one whose piece reaches cell 37, or whose piece reaches the highest numbered cell before 37. If a player whose piece was behind overtakes the others (from cell 8), the other players can take a further risk by throwing again. If all players land on the same cell and no one wishes to thrown again, the game ends in a draw. If the players then wish to carry on playing, they must begin again from 0, or, if they do not wish to continue playing, the bets in the bank are divided in equal proportions. The players place equal bets and the winner takes all.

Lotto 6-pointed-Superstar

The game can be played by 2 to 4 persons, or even by 1 person using chips of four colors. Each player must place bets on 7 numbers. Seven different numbers are drawn. The players can choose the size of their bets. The amount they win depends on how many numbers they get right out of the seven. This is illustrated in the table below.

| Number found | Winnings |
|---|---|
| 0 | Gets back the amount of the bet |
| 1 | Loses |
| 2 | Loses |
| 3 | Gets back double the bet placed |
| 4 | Gets back the bet placed +5 times the bet |
| 5 | Gets back the bet placed +100 times the bet |
| 6 | Gets back the bet placed +5,000 times the bet |
| 7 | Gets back the bet placed +100,000 times the bet |

Figure 40:
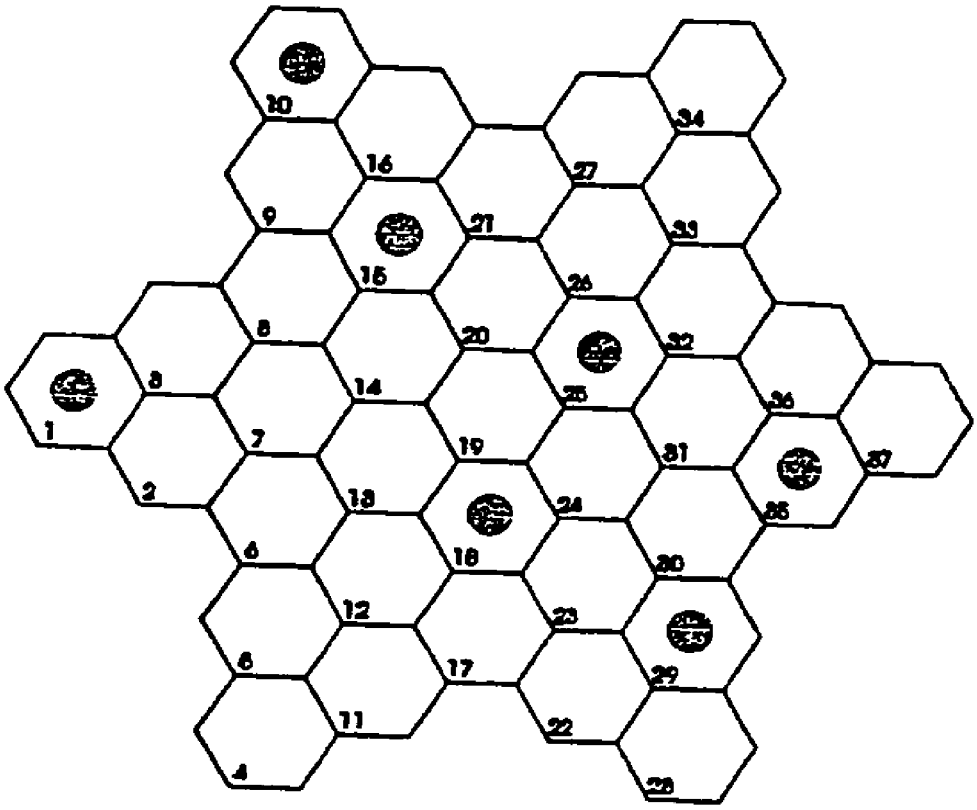

This embodiment is shown in FIG. 40.

The player placed chips on the following cells: 1, 10, 15, 18, 25, 29, and 35, as shown in the diagram. The numbers drawn are 9, 15, 27, 29, 32 and 35. In this case the player has three wins, 9, 15 and 35. If, for example, the player's bet was 30 units, he or she gets this back plus another 30 units.

Superstar Roulette (Diagram: xx adjacent numbers)

Multiple possibilities:

| | | |
|---|---|---|
| (a) | one whole number | 35× |
| (b) | two adjacent numbers | 7× |
| (c) | three adjacent numbers | 11× |
| (d) | 5 adjacent numbers in columns or diagonals | 6× |
| (e) | 6 adjacent numbers in columns or diagonals | 5× |
| (f) | 7 adjacent numbers in columns or diagonals | 4× |

Simple possibilities:

| | | |
|---|---|---|
| (g) | all red numbers | 1× |
| (h) | all black numbers | 1× |
| (i) | all even numbers | 1× |
| (j) | all odd numbers | 1× |
| (k) | all numbers between 1 and 18 | 1× |
| (l) | all numbers between 19 and 36 | 1× |

(k) all numbers between 1 and 18 1×

(l) all numbers between 19 and 36 1×

0 should be regarded as a whole number

37=0 loses, the bank wins everything

0=37, that is, that is, 0 functions as any other number. The player determines the size of the bet.

Figure 41A:
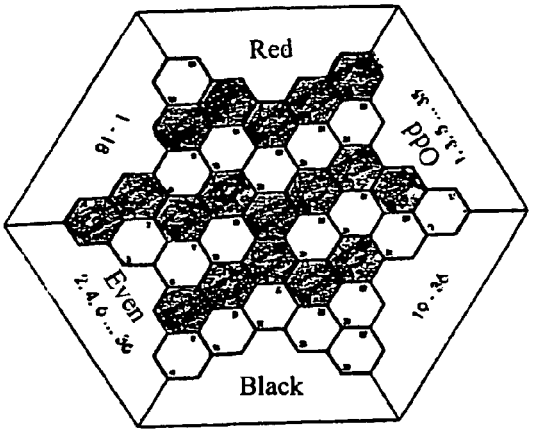
Figure 41B:
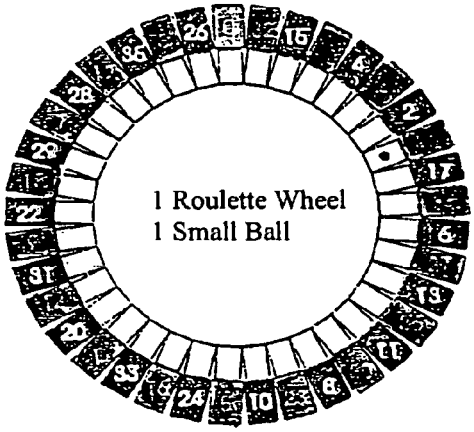

This embodiment is shown in FIGS. 41A and 41B.

Polgár Superstar Chess—"Grand" Version

Number of cells: 73

(One Possible Setup)

The rules are identical to those for 37-cell Polgár Superstar Chess.

Setup: 1 king, 1 rook, 1 bishop, 2 queens, 2 knights.

In total 7 pawns and 7 major pieces.

Figure 42:
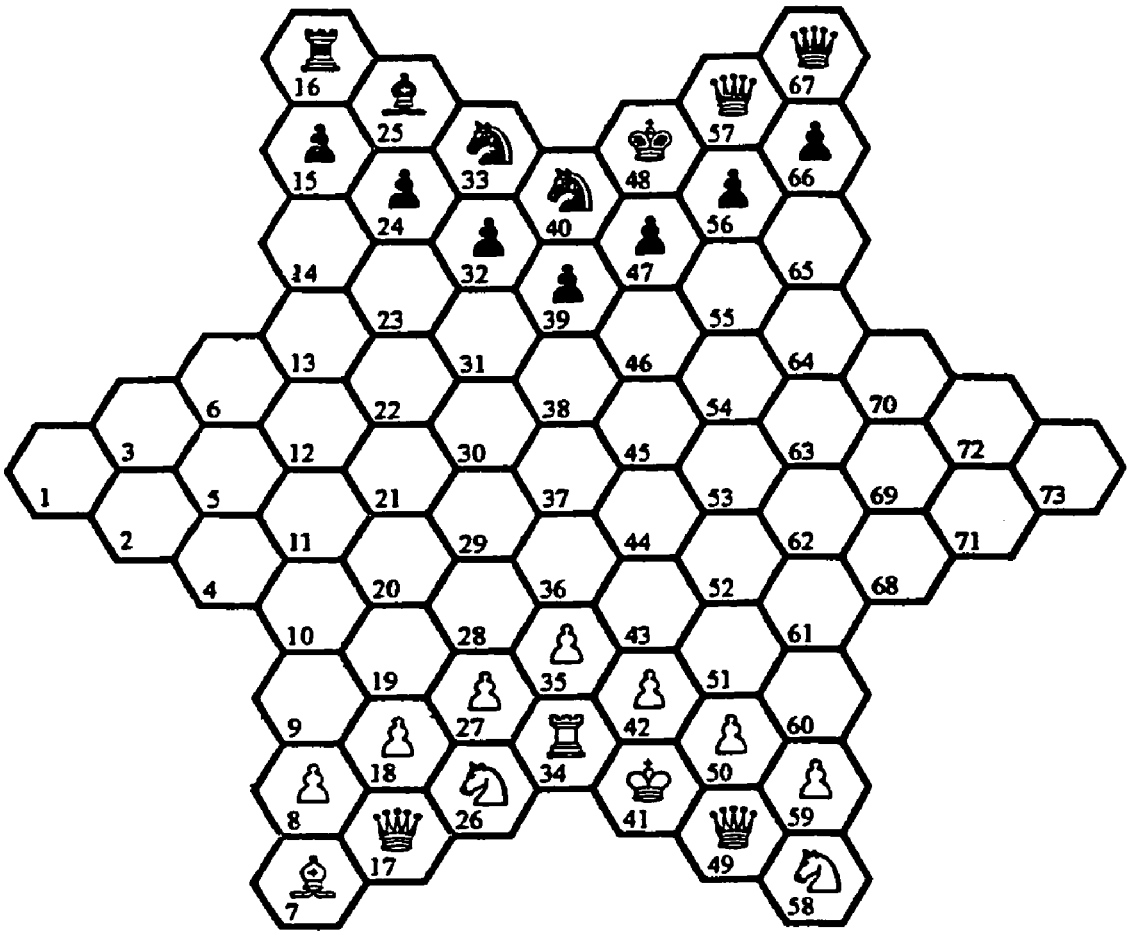

This embodiment is shown in FIG. 42.

Polgár Superstar Grand Roulette table of winnings (Diagram: Xx Adjacent Numbers)

Multiple possibilities:

one whole number 72× two adjacent numbers 35× three adjacent numbers 23×

7 adjacent numbers in columns or diagonals 9×

Figure 43:
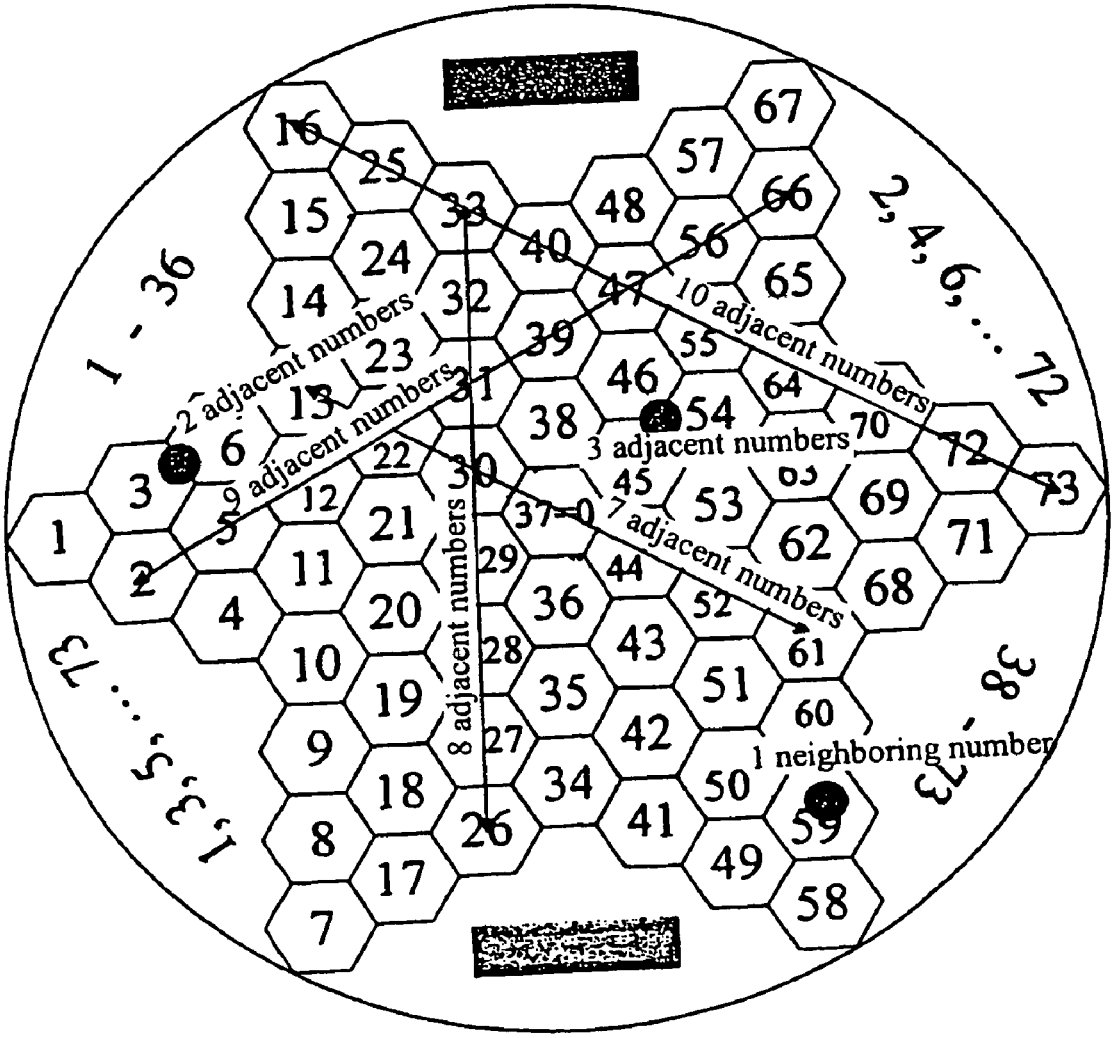

8 adjacent numbers in columns or diagonals 8×
9 adjacent numbers in columns or diagonals 7×
10 adjacent numbers in columns or diagonals 6×
Simple possibilities:
g. all red numbers 1×
b. all black numbers 1×
i. all even numbers 1×
j. all odd numbers 1×
k. all numbers between 1 and 36 1×
l. all numbers between 38 and 73 1×
0 should be regarded as a whole number
37=0 loses, the bank wins everything
This embodiment is shown in FIG. 43.

What is claimed is:

1. A board for playing games of logic or chance composed of a plurality of hexagonal playing fields arranged in a six-pointed configuration, each hexagonal playing field having six edges of equal length arranged to form six corners, said board consisting of:

a first hexagonal playing field having a first edge adjacent to a second edge that are connected to form a first primary corner of said board;

a first row of hexagonal playing fields connecting to and extending from said first hexagonal playing field, said first row of hexagonal playing fields comprising a plurality of interlocking hexagonal playing fields each having a pair of edges parallel to the first edge of the first hexagonal playing field, said first row of hexagonal playing fields terminating in a last hexagonal playing field having two edges that connect to form a second primary corner of said board;

a second row of hexagonal playing fields connecting to and extending from said first hexagonal playing field, said second row of hexagonal playing fields comprising a plurality of interlocking hexagonal playing fields each having a pair of edges parallel to the second edge of the first hexagonal playing field, said second row of hexagonal playing fields terminating in a last hexagonal playing field having two edges that connect to form a third primary corner of said board;

a third row of hexagonal playing fields connecting to and extending from said last hexagonal playing field of said first row of hexagonal playing fields to said last hexagonal playing field of said second row of hexagonal playing fields, said third row of hexagonal playing fields comprising a plurality of interlocking hexagonal playing fields each having a pair of edges parallel to one another, said third row of hexagonal playing fields spanning between said second and third primary corners of said board such that said first, second, and third rows of hexagonal playing fields form an equilateral triangle bounded by said first, second, and third primary corners of said board;

a plurality of internal rows of hexagonal playing fields parallel to said first row of hexagonal playing fields and connecting to and extending from said second row of hexagonal playing fields to said third row of hexagonal playing fields, each said internal row of hexagonal playing fields comprising a plurality of interlocking hexagonal playing fields each having a pair of edges parallel to one another;

a first triangular region of hexagonal playing fields connecting to and extending from a midpoint of said first row of hexagonal playing fields, said first triangular region comprising a plurality of hexagonal playing fields arranged to form an equilateral triangle, said first triangular region of hexagonal playing fields having a point opposite said first row of hexagonal playing fields that forms a first secondary corner of said board;

a second triangular region of hexagonal playing fields connecting to and extending from a midpoint of said second row of hexagonal playing fields, said second triangular region comprising a plurality of hexagonal playing fields arranged to form an equilateral triangle, said second triangular region of hexagonal playing fields having a point opposite said second row of hexagonal playing fields that forms a second secondary corner of said board;

a third triangular region of hexagonal playing fields connecting to and extending from a midpoint of said third row of hexagonal playing fields, said third triangular region comprising a plurality of hexagonal playing fields arranged to form an equilateral triangle, said third triangular region of hexagonal playing fields having a point opposite said third row of hexagonal playing fields that forms a third secondary corner of said board, said first, second, and third primary corners and said first, second, and third secondary corners defining an outer boundary of said game board, said outer boundary encompassing said first, second, and third rows of hexagonal playing fields and said first, second, and third triangular regions of hexagonal playing fields; and further consisting of at least five majors chess pieces and at least five pawns assigned to a player of said board game, said major chess pieces initially arranged on at least a portion of said outer boundary of said game board extending from one of said first, second, or third primary corners of said game board, said at least five major chess pieces comprising:

a king configured to move from one playing field to any one neighboring playing field;

at least one queen, each said quenn configured to move from one playing field to any number of neighboring playing fields in a diagonal direction that are not occupied by any pieces of an opposing player;

a rook configured to move from one playing field to any number of neighboring playing fields in a vertical direction, said rook being further configured to capture any pieces of said opposing player occupying any neighboring playing fields located in said vertical direction from said rook;

a bishop configured to move from one playing field to any number of neighboring playing fields in a diagonal direction, said bishop being further configured to capture any pieces of said opposing player occupying any neighboring playing fields located in said diagonal direction from said bishop; and at least one knight configured to move from one playing field along a path to another playing field, said path comprising two neighboring playing fields in either a vertical or diagonal first direction, followed by one neighboring playing field in a second direction 120 degrees from said first direction; and each said pawn configured to move from one playing field to a neighboring playing field in either a forward vertical or diagonal direction, not to exceed a distance of two neighboring playing fields, each said pawn further configured to be promoted to any of said major pieces of the same player except for a king.

2. The game board according to claim 1 wherein the first, second, and third rows each comprise seven hexagonal playing fields.

3. The game board according to claim 1 wherein the first, second, and third rows each comprise ten hexagonal playing fields.

4. A board game in accordance with claim 1, further consisting of a computer configured to execute a computer program, said computer program configured to facilitate the teaching or playing of the game.

5. A board game in accordance with claim 1 wherein the board comprises 37 primary playing fields, and the major pieces comprise one king, one queen, one rook, one bishop and one knight for each player.

6. A board game in accordance with claim 1 wherein the board comprises 73 primary playing fields, and the major pieces comprise one king, two queens, one rook, one bishop and two knights for each player.

7. A board game in accordance with claim 1 further consisting of knight pieces configured to play horse race.

8. A board game in accordance with claim 1 further consisting of pawn and king pieces configured to play pawn war.

9. A board game in accordance with claim 1 wherein the major pieces are configured to play French chess.

10. A board game in accordance with claim 1 further consisting of tokens configured to play halma.

11. A board game in accordance with claim 1 further consisting of tokens configured to play pyramid.

12. A board game in accordance with claim 1 further consisting of tokens configured to play checkers (shashki).

13. A board game in accordance with claim 1 further consisting of tokens configured to play triangles (merelles).

14. The board game in accordance with claim 1 further consisting of a roulette cylinder configured to generate a random number.

15. A board game in accordance with claim 14, further consisting of one chess queen piece and tokens configured to play (chess-) queen roulette.

16. A board game in accordance with claim 14, further consisting of rook and bishop chess pieces and tokens configured to play rook-bishop roulette.

17. A board game in accordance with claim 14, further consisting of king, knight and pawn chess pieces and tokens configured to play king-knight-two pawn roulette.

18. A board game in accordance with claim 14, further consisting of tokens configured to play lotto.

19. A board game in accordance with claim 14, further consisting of major chess pieces configured to play Lotto chess.

20. A board game in accordance with claim 14, further consisting of tokens configured to play roulette.

21. A board game in accordance with claim 14, further consisting of tokens configured to play dreidel.

22. A board game in accordance with claim 14, further consisting of tokens configured to play blackjack. consisting of at least five major chess pieces and at least five pawns assigned to a player of said game board, said major chess pieces initially arranged on at least a portion of said outer boundary of said game board extending from one of said first, second, or third primary corners of said game board, said at least five major chess pieces comprising:

a king configured to move from one playing field to any one neighboring playing field;

at least one queen, each said queen configured to move from one playing field to any number of neighboring playing fields in a diagonal direction that are not occupied by any pieces of an opposing player;

a rook configured to move from one playing field to any number of neighboring playing fields in a vertical direction, said rook being further configured to capture any pieces of said opposing player occupying any neighboring playing fields located in said vertical direction from said rook;

a bishop configured to move from one playing field to any number of neighboring playing fields in a diagonal direction, said bishop being further configured to capture any pieces of said opposing player occupying any neighboring playing fields located in said diagonal direction from said bishop; and at least one knight configured to move from one playing field along a path to another playing field, said path comprising two neighboring playing fields in either a vertical or diagonal first direction, followed by one neighboring playing field in a second direction 120 degrees from said first direction; and each said pawn configured to move from one playing field to a neighboring playing field in either a forward vertical or diagonal direction, not to exceed a distance of two neighboring playing fields, each said pawn further configured to be promoted to any of said major pieces of the same player except for a king

* * * * *

UNITED STATES PATENT AND TRADEMARK OFFICE

CERTIFICATE OF CORRECTION

Figure 1:
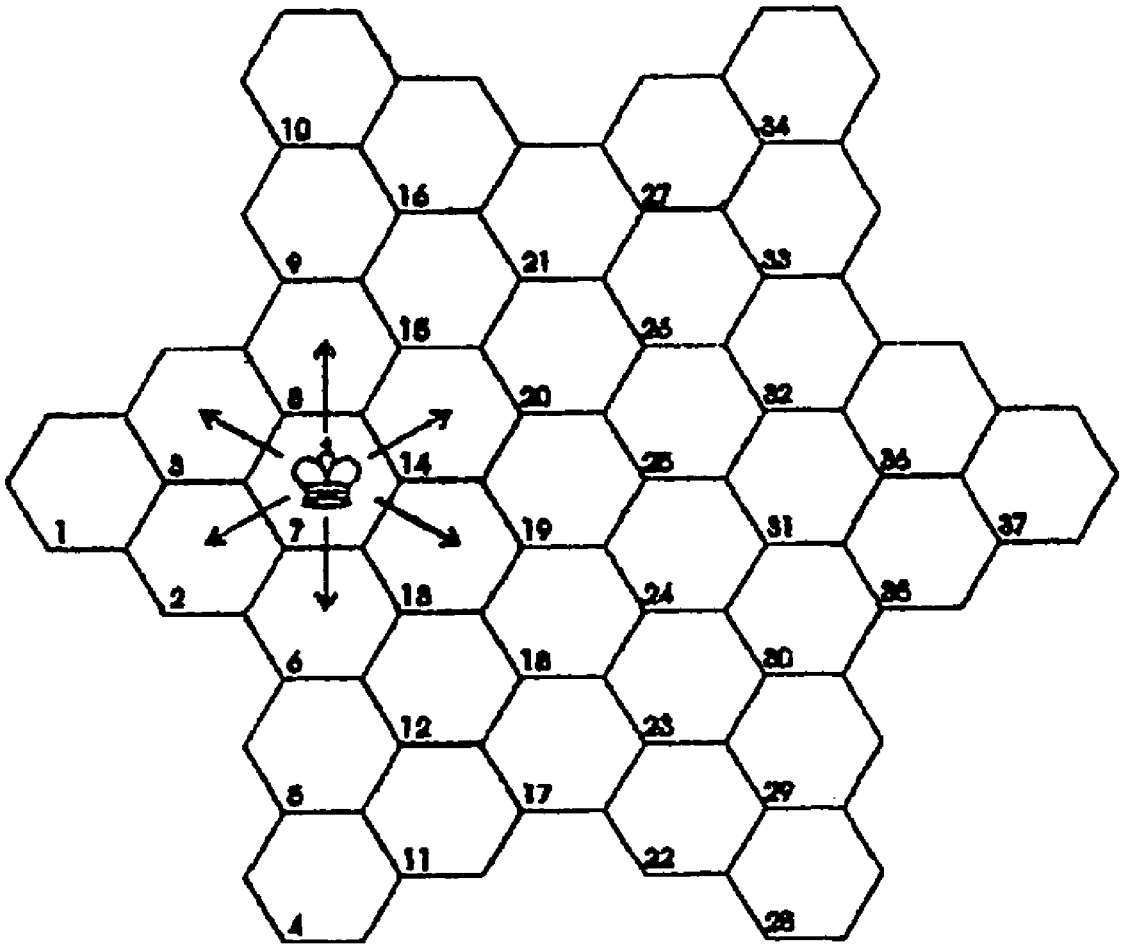
FIGS. 1-6 depict the movement of the individual chess pieces.
Figure 2:
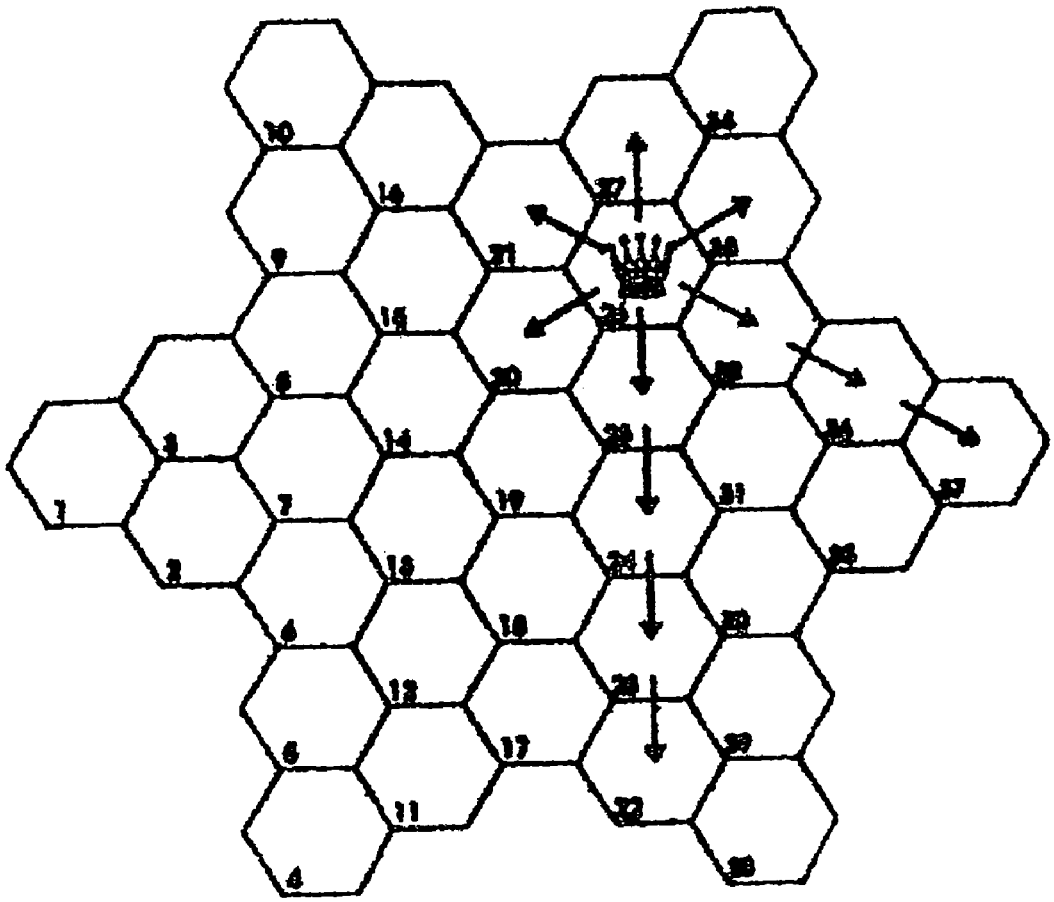
Figure 3:
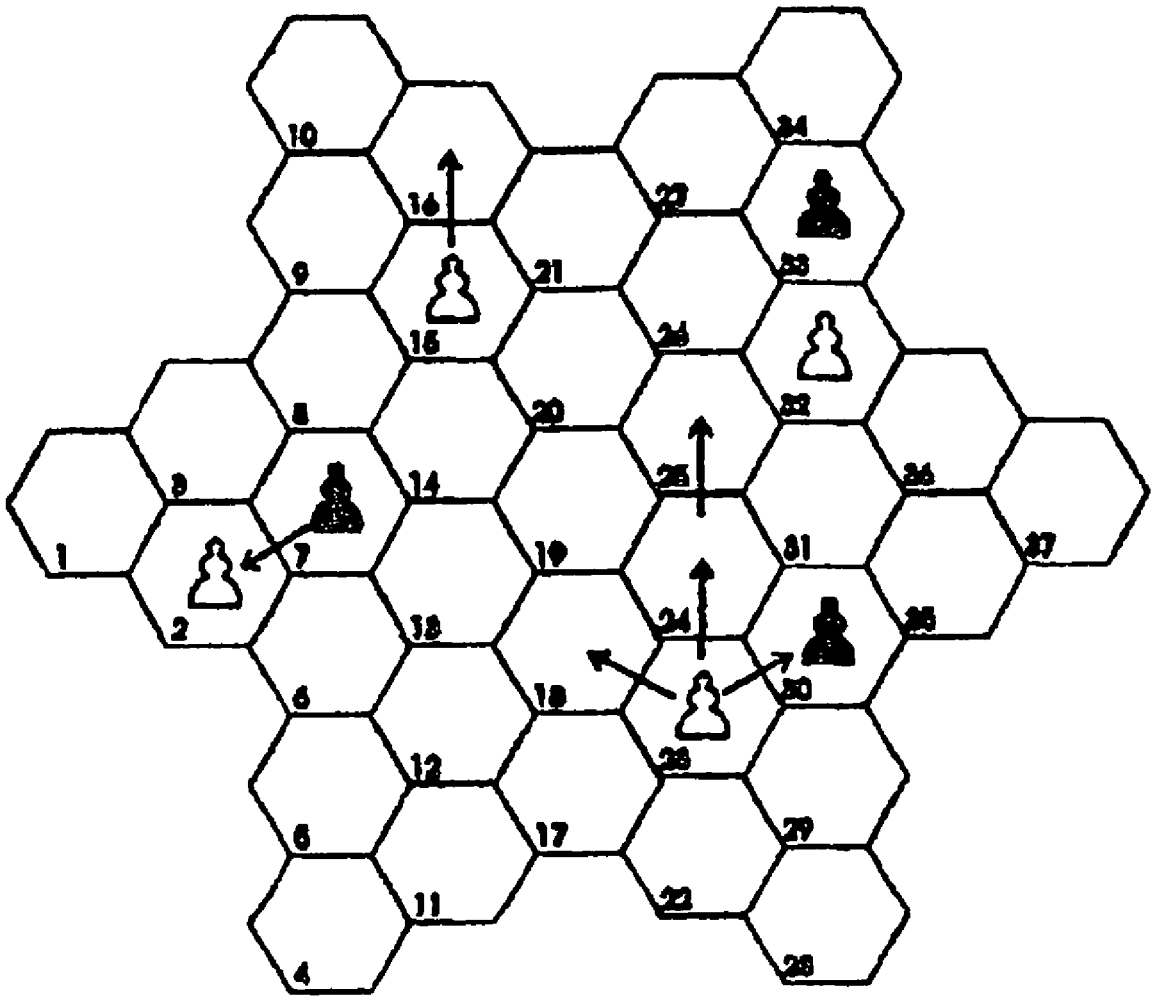
Figure 4:
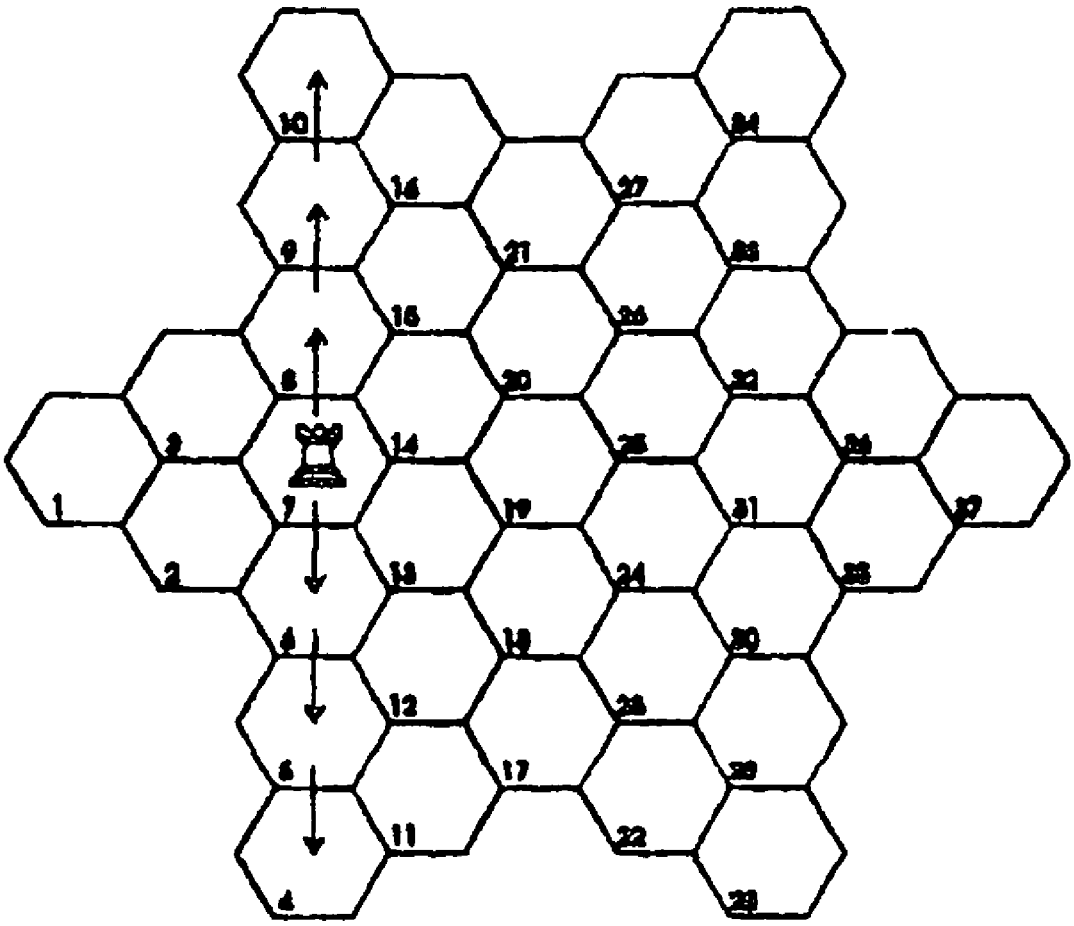
Figure 5:
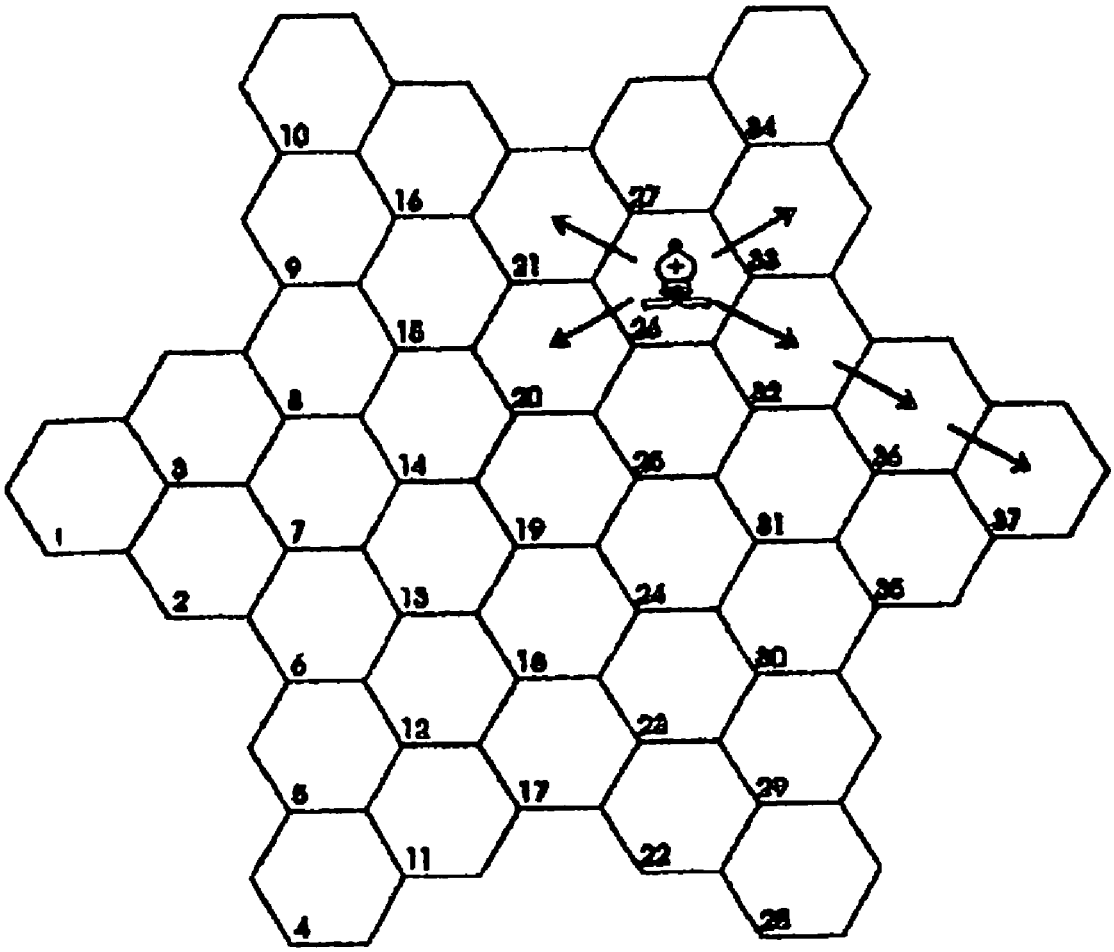
Figure 6:
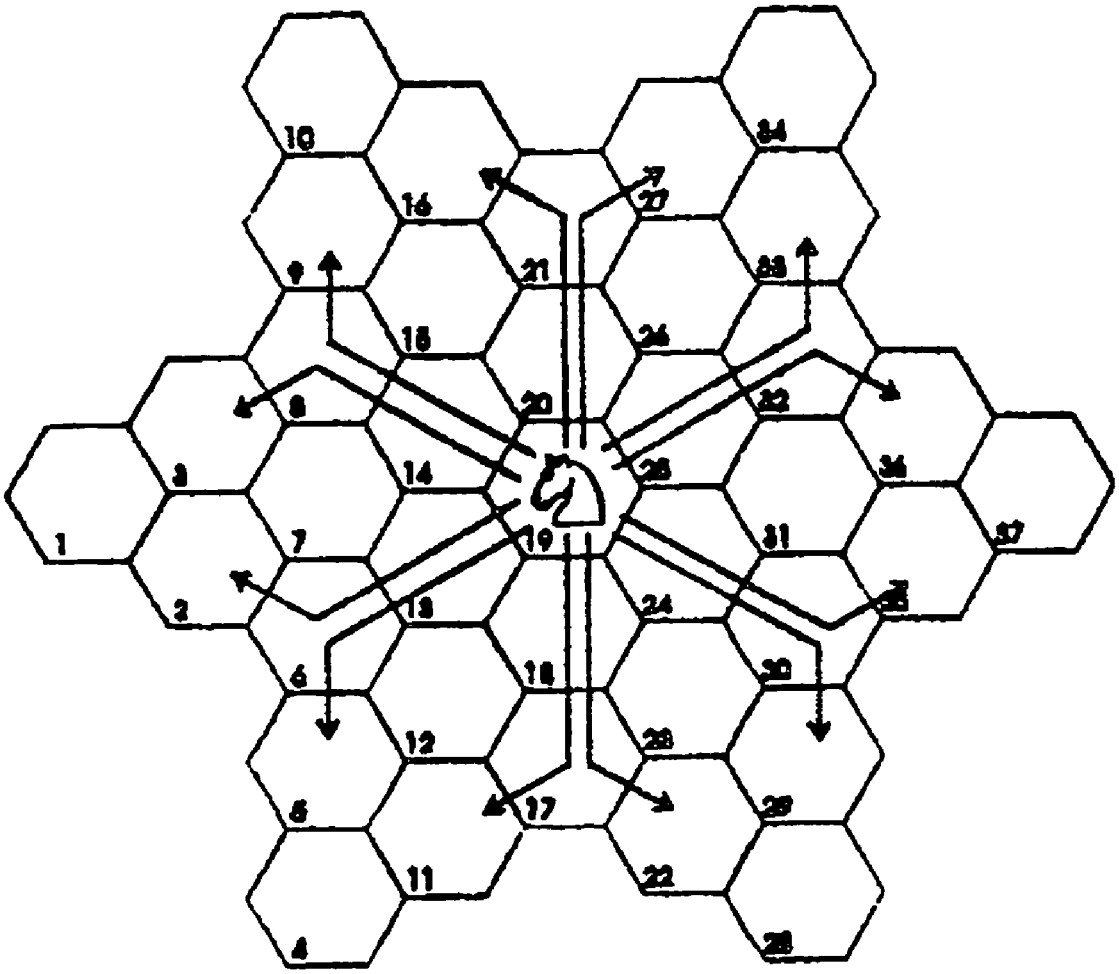
Figure 7:
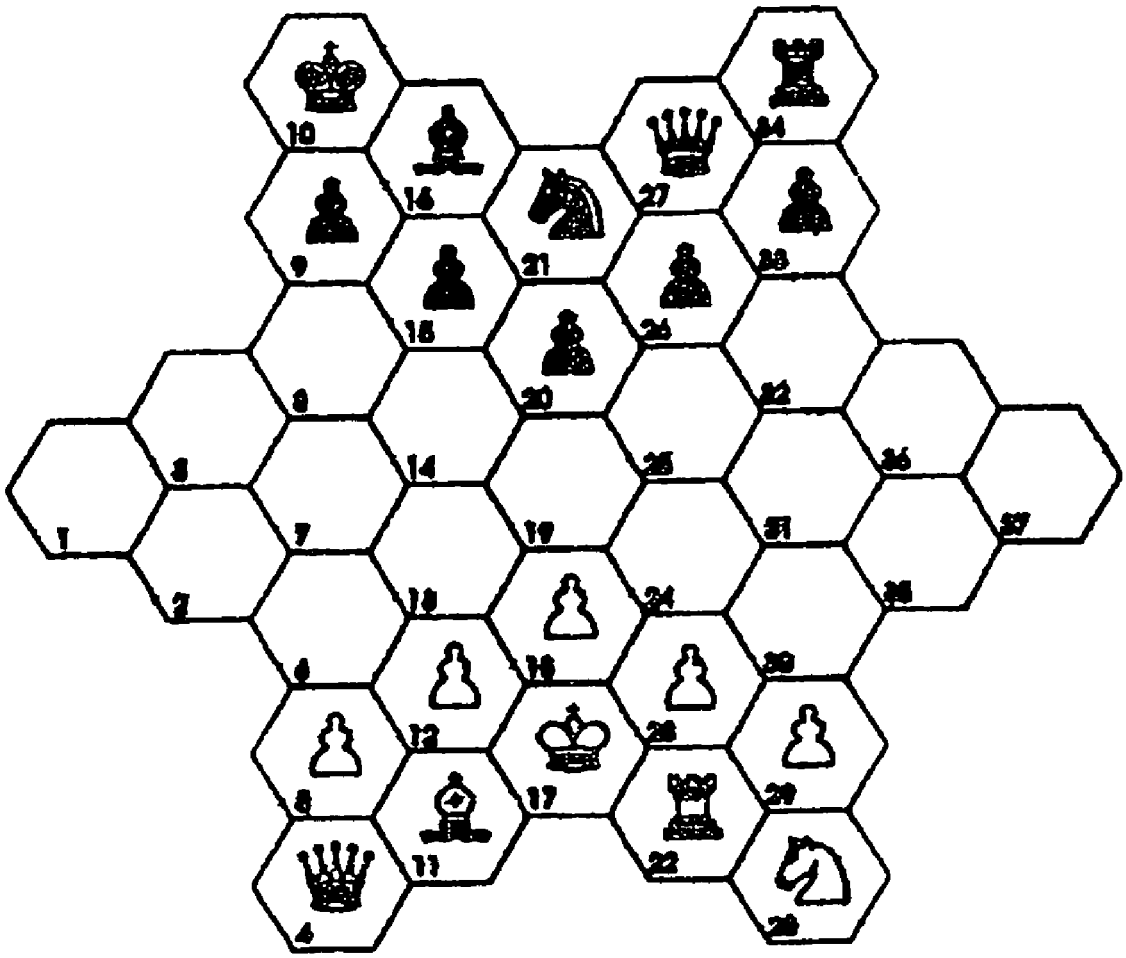
FIG. 7 depicts the basic setup of the chess pieces in the playing area according to one of the designs.

PATENT NO. : 7,708,279 B2
APPLICATION NO. : 11/361271
DATED : May 4, 2010
INVENTOR(S) : Laszlo Polgar It is certified that error appears in the above-identified patent and that said Letters Patent is hereby corrected as shown below:

In the Specification:

Col. 4, line 2, delete "FIGS. 21-43", and add -- FIGS. 21-25 --.
Col. 6, line 48, delete "diagram 1", and add -- FIG. 1 --.
Col. 6, lines 54-55, delete "diagram 2", and add -- FIG. 2 --.
Col. 7, line 6, delete "diagram 3", and add -- FIG. 3 --.
Col. 7, line 14, delete "diagram 4", and add -- FIG. 4 --.
Col. 7, line 18, delete "diagram 5", and add -- FIG. 5 --.
Col. 7, line 21, delete "diagram 6", and add -- FIG. 6 --.
Col. 7, line 26, delete "Diagram 7", and add -- FIG. 7 --.
Col. 7, line 33, delete "Diagram 8", and add -- FIG. 8 --.

Col. 7, line 34, add -- Sample Game: I.22Q 21B II.28R 27N III.17N 16Q IV.4K 34K V.28R 10R (KBNQR/RQBNK) 1.P24 P7 2.P6 P13 3.P31 B1 4.K5 P18 5.P18 N9 6.P19 N2! 7.B4 Q13!! 8.Q29 Q6! 9.K6 N19# --.

Figure 10:
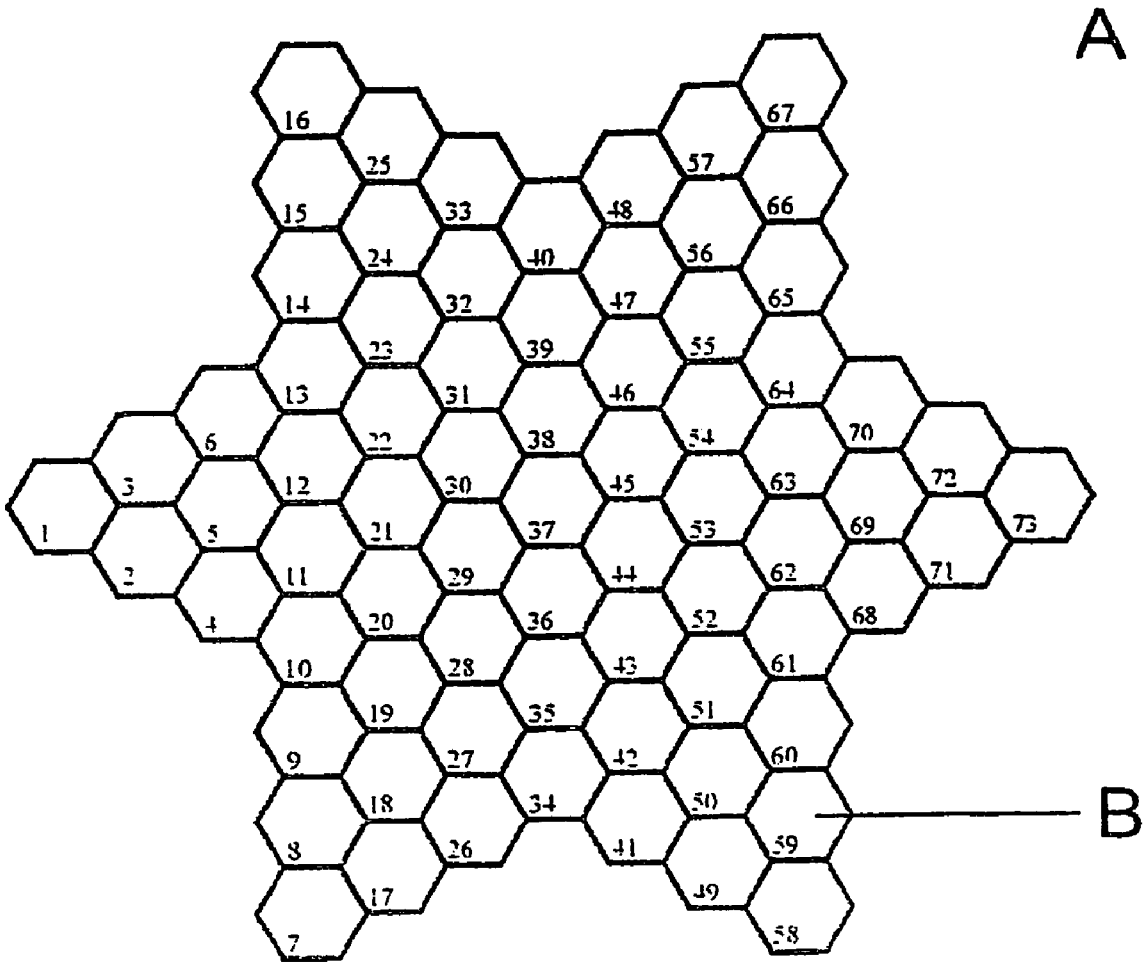
FIG. 10 shows the empty playing area (A) comprising 73 numbered playing fields (B)
Figure 11:
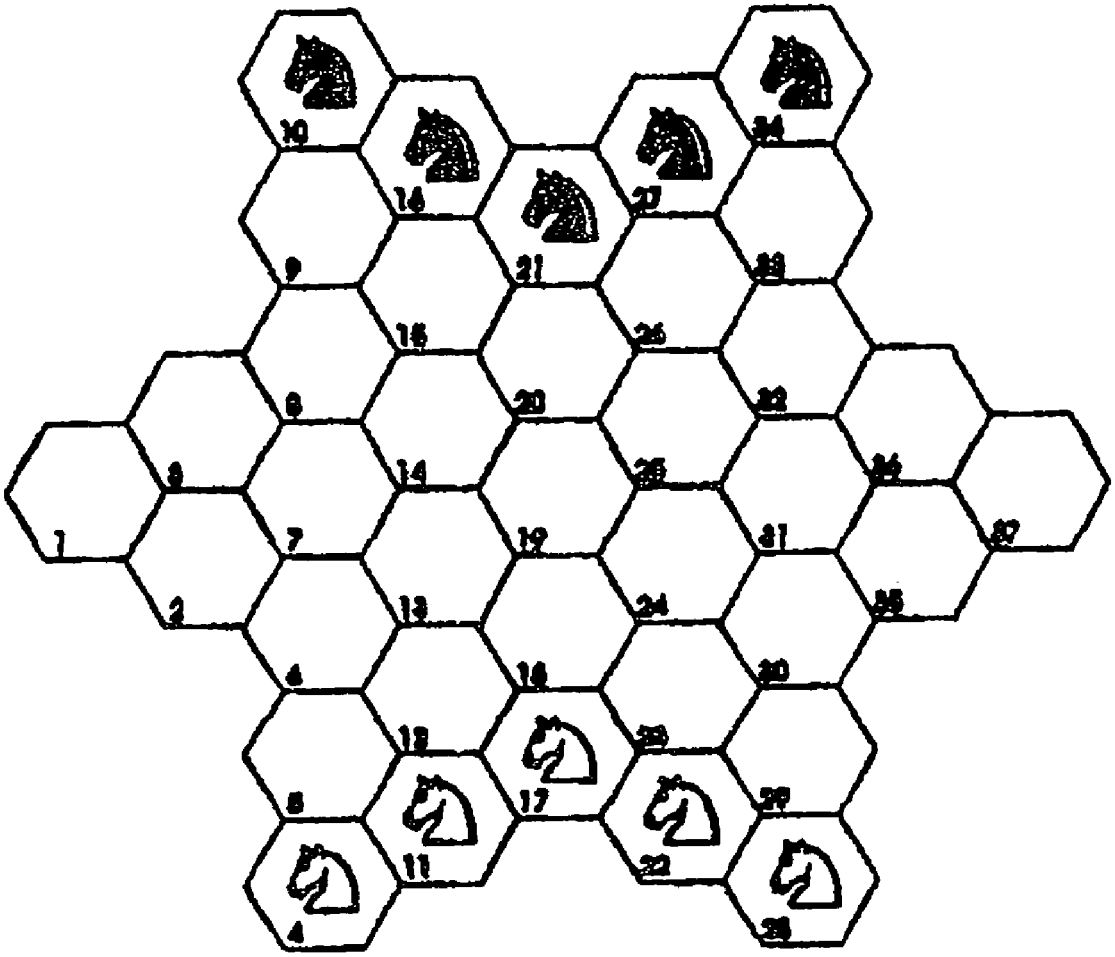
FIG. 11 shows the playing area set out for the game horse race.
Figure 12:
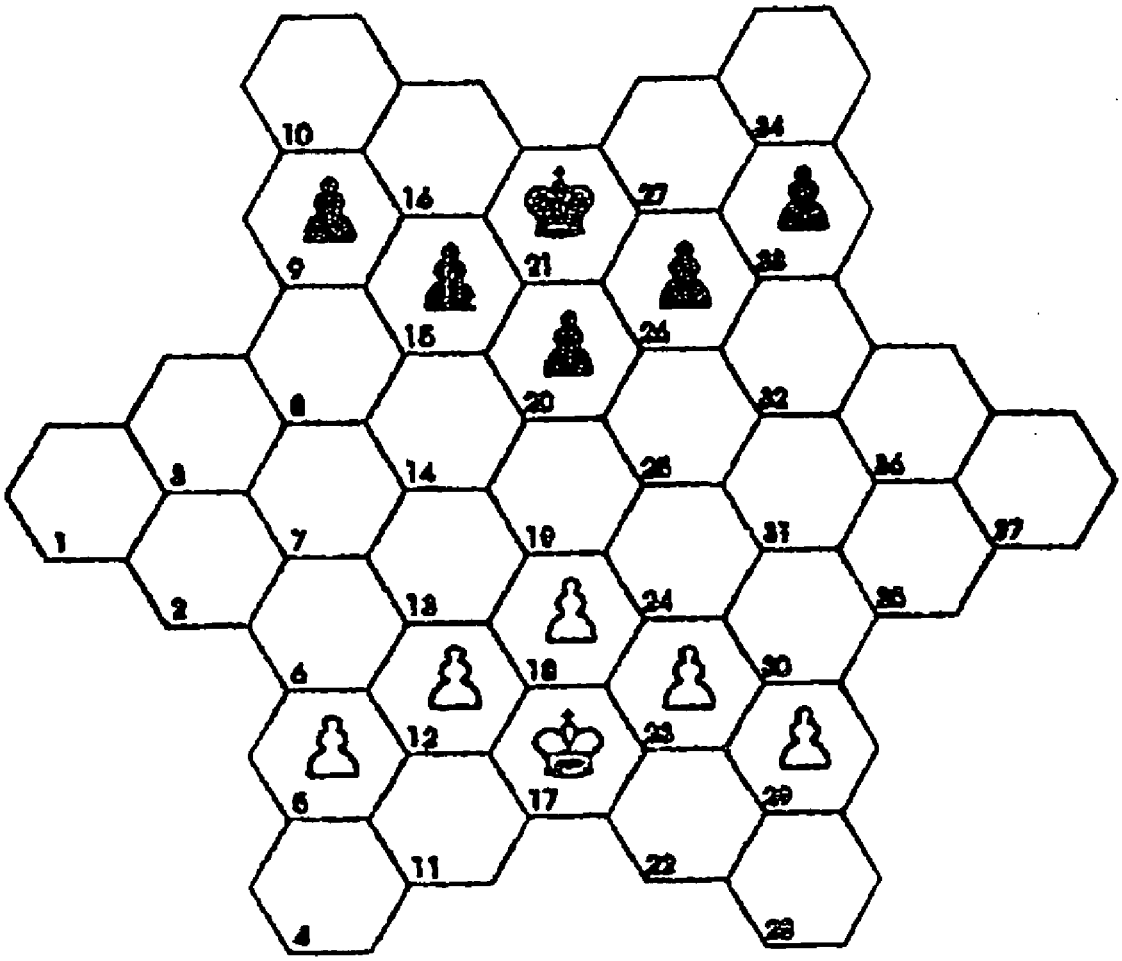
FIG. 12 shows the playing area set out for the game pawn war.
Figure 13:
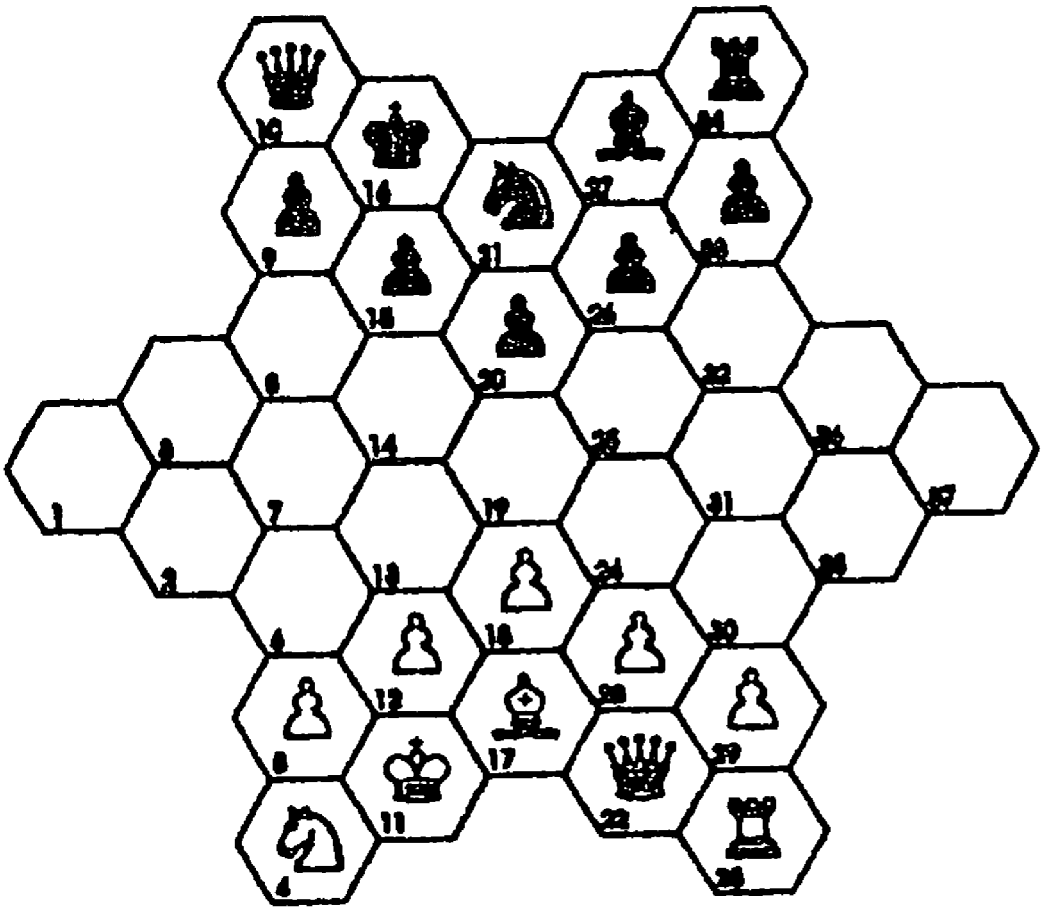
FIG. 13 shows the playing area set out for French chess.
Figure 14:
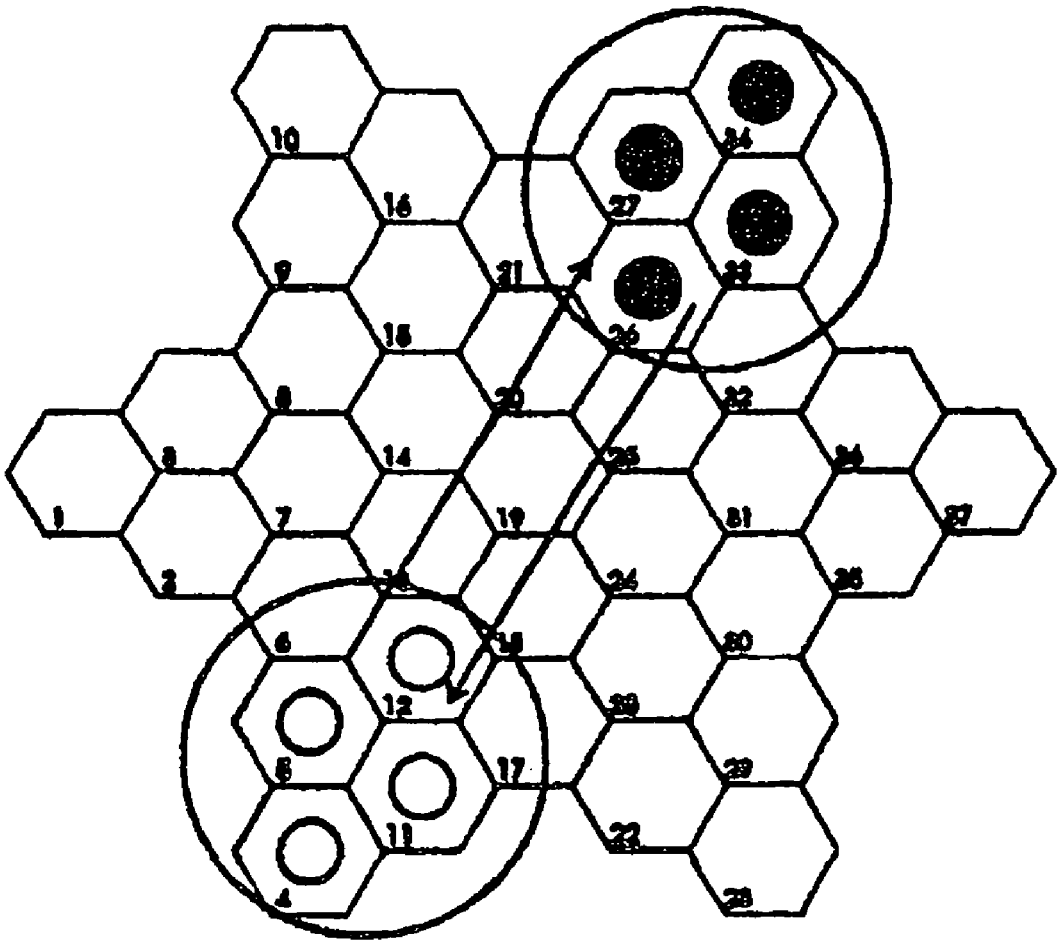
FIG. 14 shows the playing area set out for halma.
Figure 15:
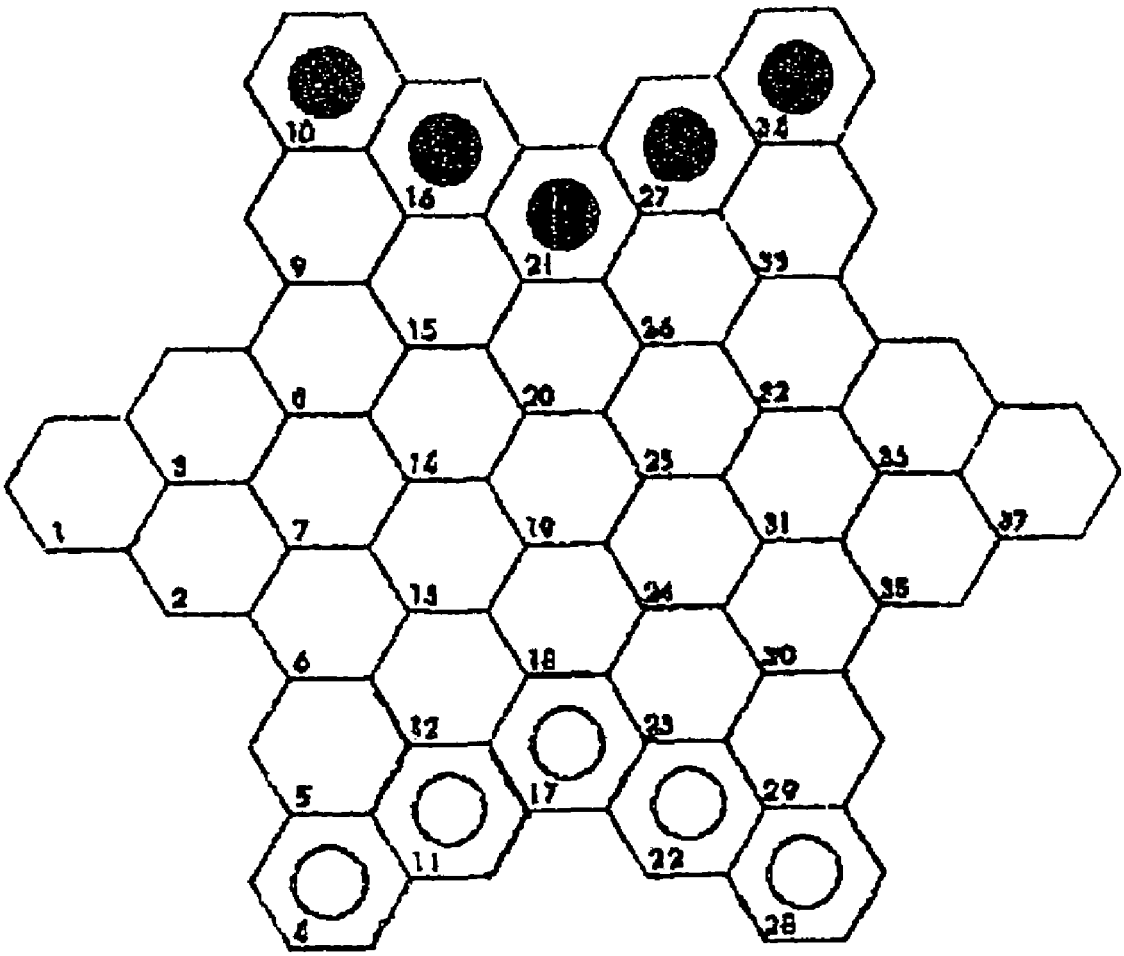
FIG. 15 shows the playing area set out for the game pyramid.
Figure 16:
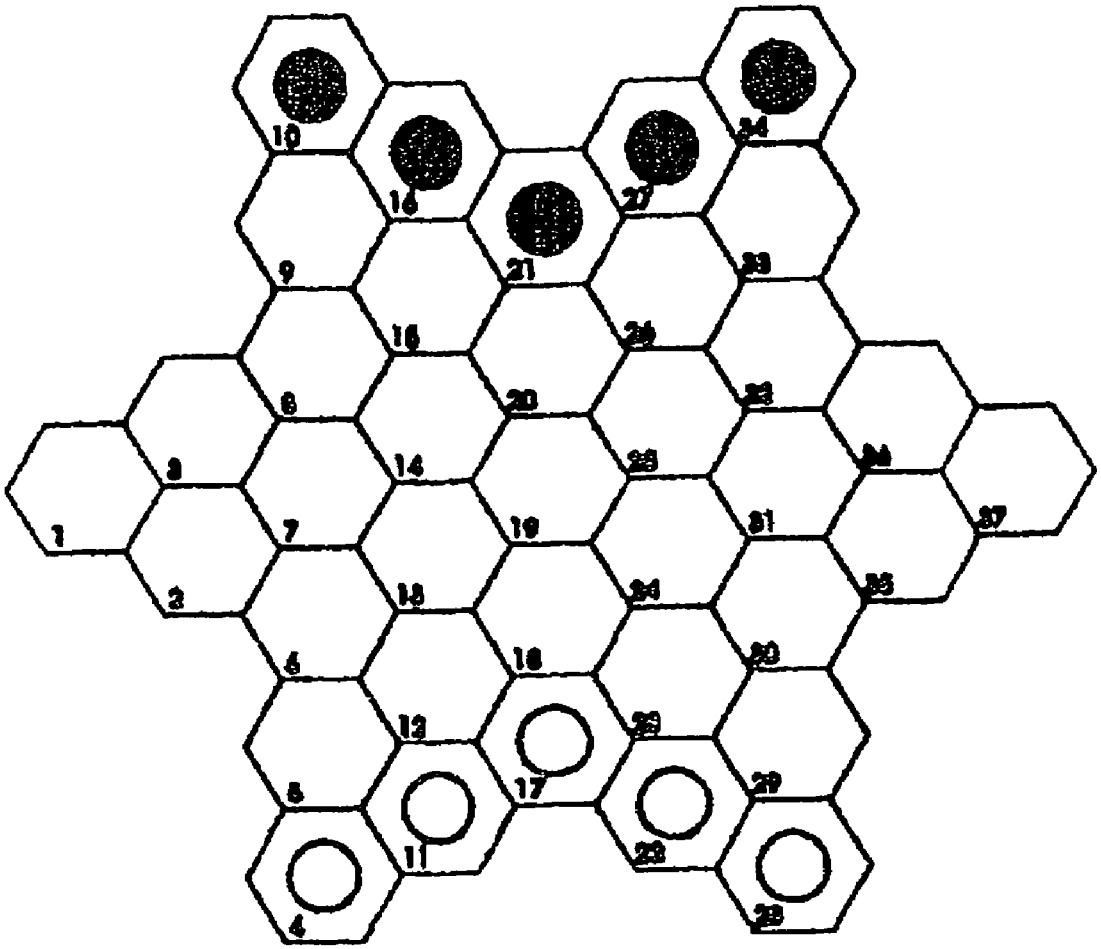
FIG. 16 shows the playing area set out for checkers (shashki)
Figure 17:
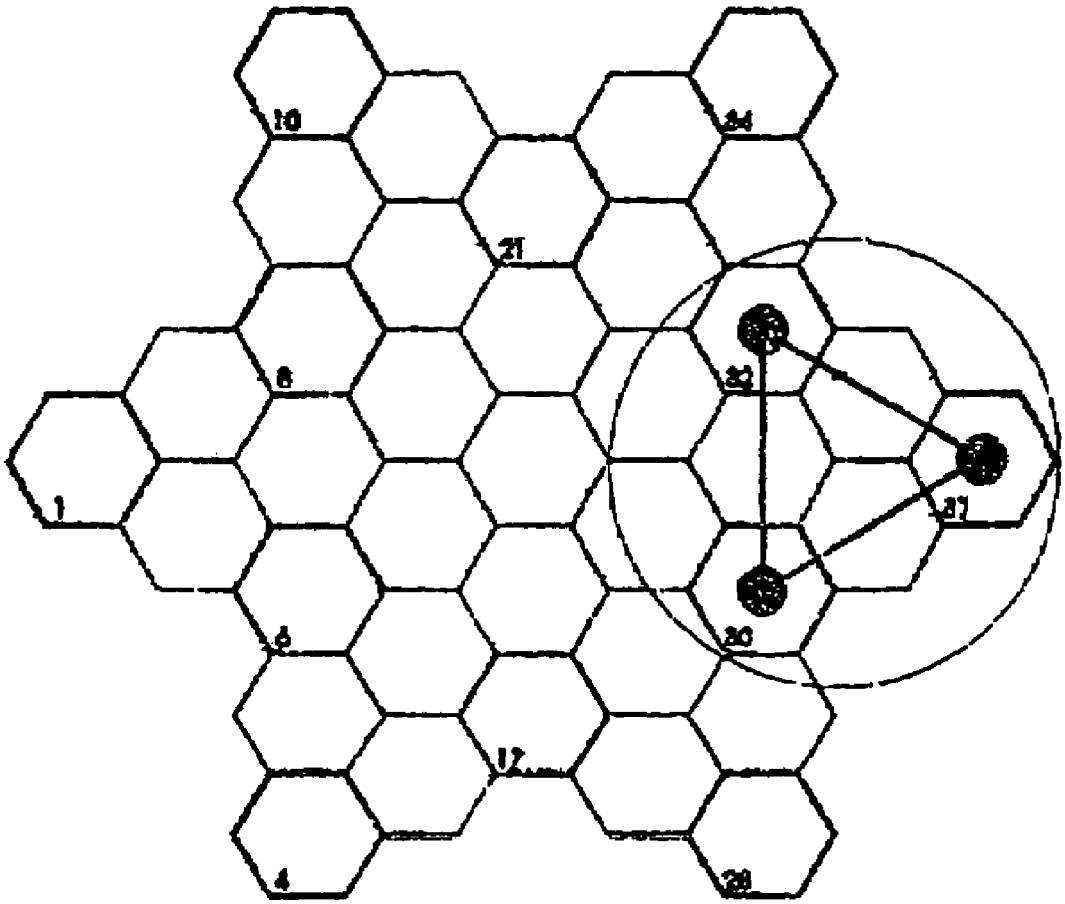
FIG. 17 shows the playing area set out for triangles (merelles)
Figure 18:
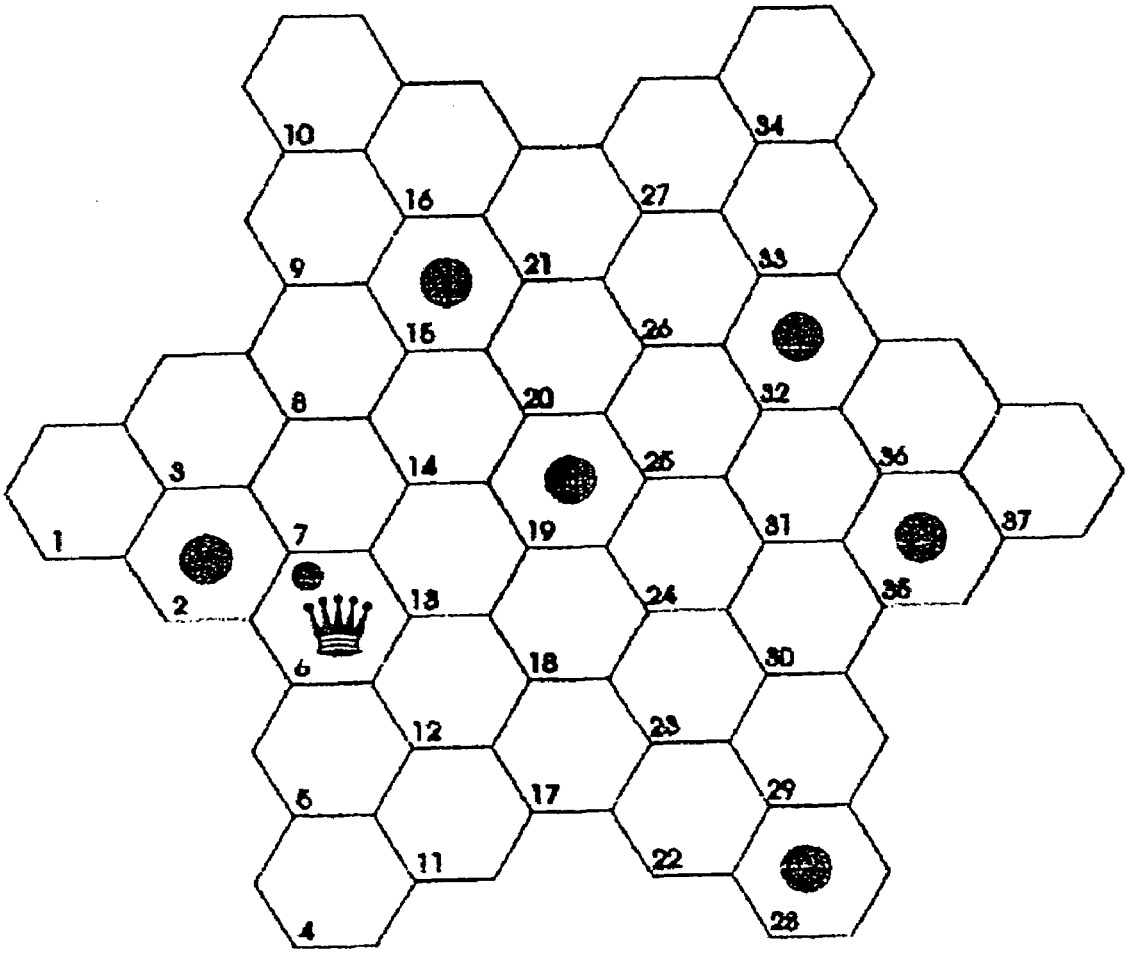
FIG. 18 shows the playing area set out for (chess-) queen roulette.
Figure 19:
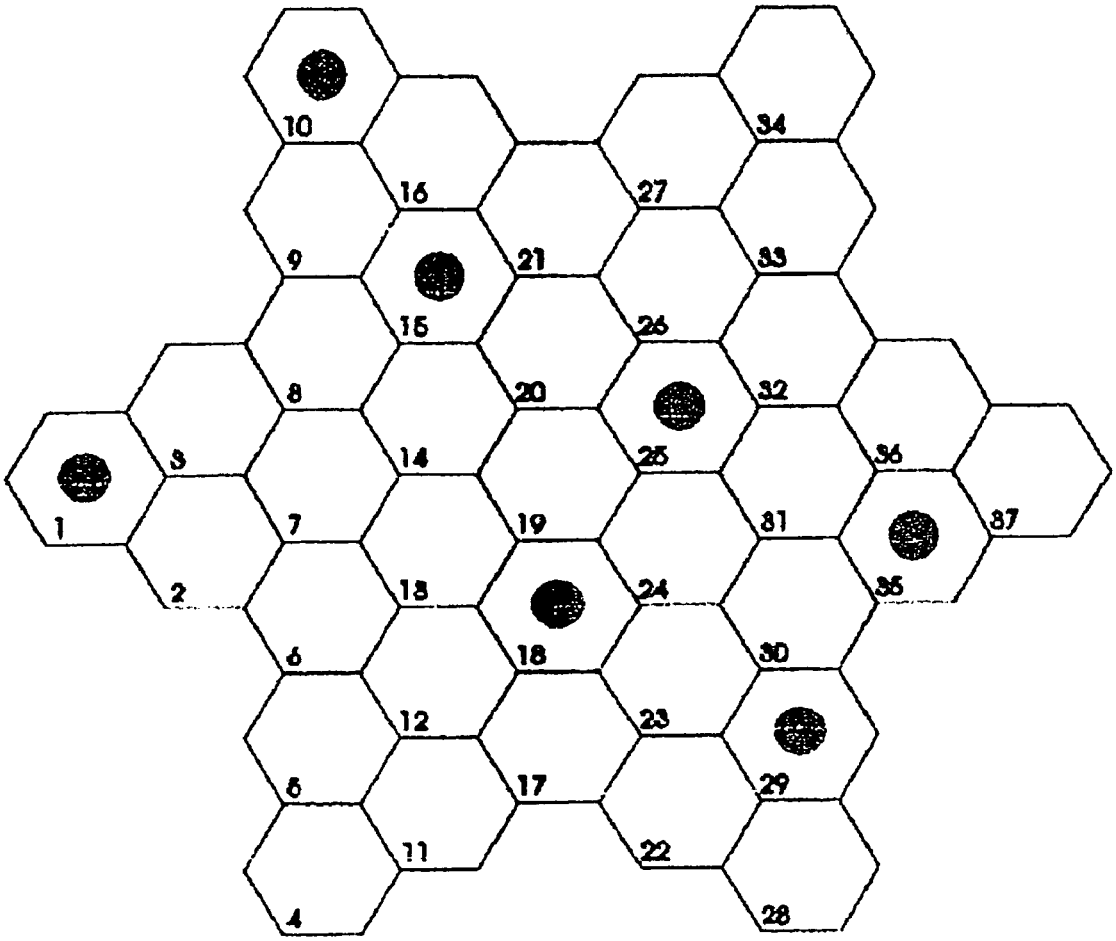
FIG. 19 shows the playing area set out for lotto.
Figure 20:
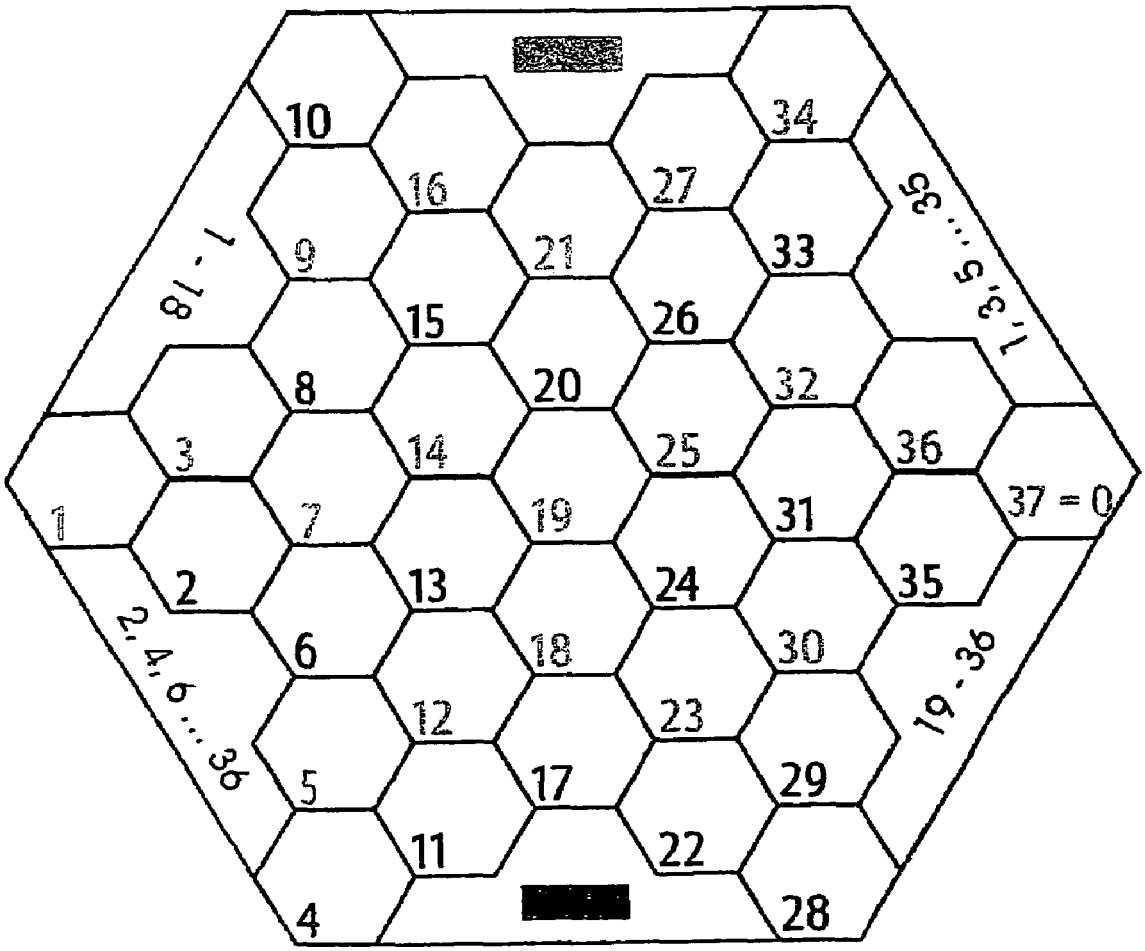
FIG. 20 shows the playing area set out for roulette.

Col. 7, line 35, delete "Diagrams 9 and 10", and add -- FIGS. 9 and 10 --.
Col. 7, line 61, delete "Diagram 11", and add -- FIG. 11 --.
Col. 8, line 18, delete "Diagram 12", and add -- FIG. 12 --.
Col. 8, line 44, delete "Diagram 13", and add -- FIG. 13 --.
Col. 9, line 5, delete "Diagram 14", and add -- FIG. 14 --.
Col. 9, line 25, delete "Diagram 15", and add -- FIG. 15 --.
Col. 9, line 52, delete "Diagram 16", and add -- FIG. 16 --.
Col. 10, line 8, delete "Diagram 17", and add -- FIG. 17 --.
Col. 11, line 63, delete "diagram 20", and add -- FIG. 20 --.

Delete Col. 14, line 62 through Col. 15, line 52.

Delete Col. 16, line 33 through Col. 20, line 51.

Signed and Sealed this
Thirtieth Day of October, 2012

David J. Kappos

David J. Kappos
*Director of the United States Patent and Trademark Office*

Figure 8:
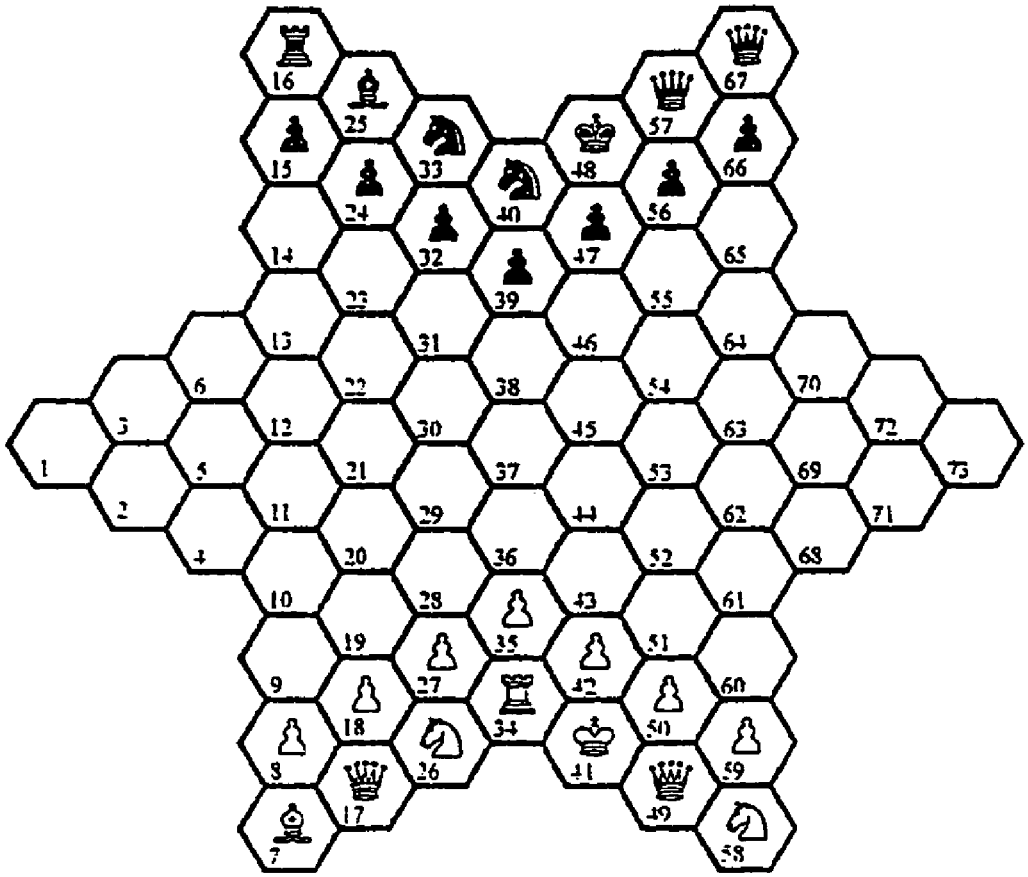
FIG. 8 depicts the basic setup of the chess pieces can be seen according to another design.

In the Specification (continued):

Col. 20, line 59, delete "FIG. 42", and add -- FIG. 8 --.

Col. 21, line 13, delete "FIG. 43", and add -- FIG. 25 --.